US005797224A

United States Patent [19]

Gunthardt

[11] Patent Number: 5,797,224

[45] Date of Patent: Aug. 25, 1998

[54] PREFABRICATED EXPANDABLE ARCHITECTURE AND METHOD OF MAKING

[76] Inventor: Ray R. Gunthardt, 1133 W. Baseline Rd. #233, Tempe, Ariz. 85283

[21] Appl. No.: 545,394

[22] Filed: Oct. 19, 1995

[51] Int. Cl.[6] ..... E04H 1/00

[52] U.S. Cl. ..... 52/79.4; 52/64; 52/127.11; 52/584.1

[58] Field of Search ..... 52/79.4, 584.1, 52/585.1, 127.11, 592.1, 64, 67, 79.1; 446/476, 110

[56] References Cited

U.S. PATENT DOCUMENTS

| | | | |
|---|---|---|---|
| 2,972,833 | 2/1961 | LaGrutta | 446/110 X |
| 3,204,586 | 9/1965 | Marsh, Jr. | 52/584.1 |
| 3,449,879 | 6/1969 | Bloom | 52/592.1 X |
| 3,485,496 | 12/1969 | Brunton | 446/110 X |
| 3,691,671 | 9/1972 | Kroll | 52/67 X |
| 3,745,725 | 7/1973 | Boucano | 52/67 |
| 3,832,810 | 9/1974 | Johnston | 52/67 |
| 4,674,241 | 6/1987 | Sarrazin | 52/67 |
| 4,676,762 | 6/1987 | Bauard | 446/110 X |
| 5,155,960 | 10/1992 | Shaanan | 52/584.1 |
| 5,156,195 | 10/1992 | Wehler et al. | 52/67 X |
| 5,497,589 | 3/1996 | Porter | 52/592.1 X |
| 5,502,939 | 4/1996 | Zadok et al. | 52/592.1 X |

FOREIGN PATENT DOCUMENTS

| | | | |
|---|---|---|---|
| 100283 | 2/1937 | United Kingdom | 446/110 |

OTHER PUBLICATIONS

Bombo Magnetic Building Blocks Mar. 10, 1966.

*Primary Examiner*—Christopher Todd Kent
*Assistant Examiner*—Yvonne Horton-Richardsen
*Attorney, Agent, or Firm*—Robert A. Parsons; Michael W. Goltry; Parsons & Goltry

[57] ABSTRACT

This invention is a prefabricated expandable architecture including a plurality of structural segments collapsible and nested together in a first configuration encompassing a first volume and expandable or extendible in a second configuration and rigidly coupled together to form a selected shape encompassing a second larger volume.

38 Claims, 9 Drawing Sheets

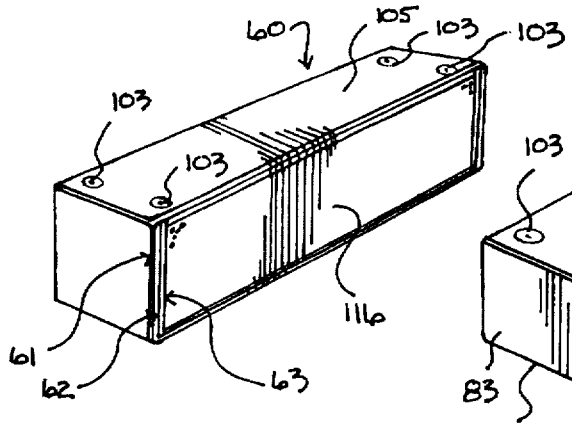
FIG. 4
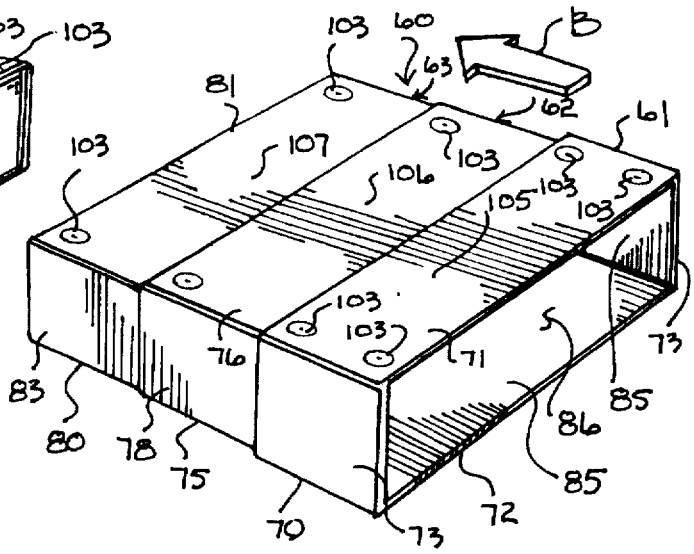
FIG. 5
FIG. 6
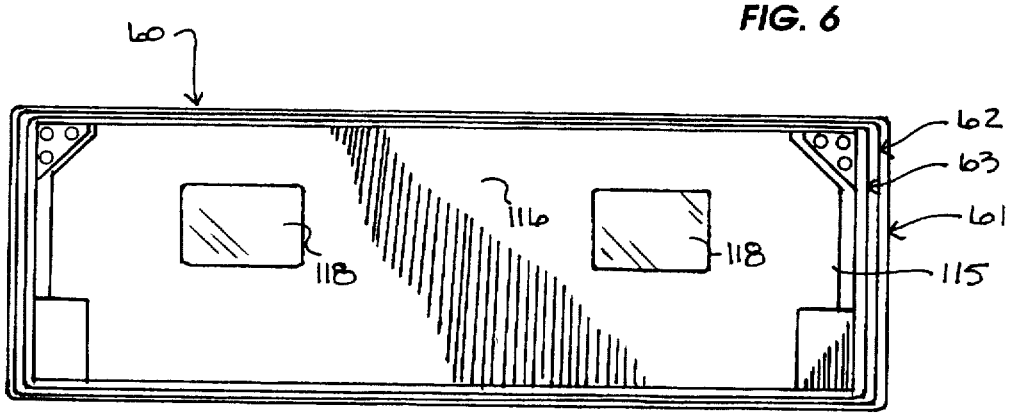

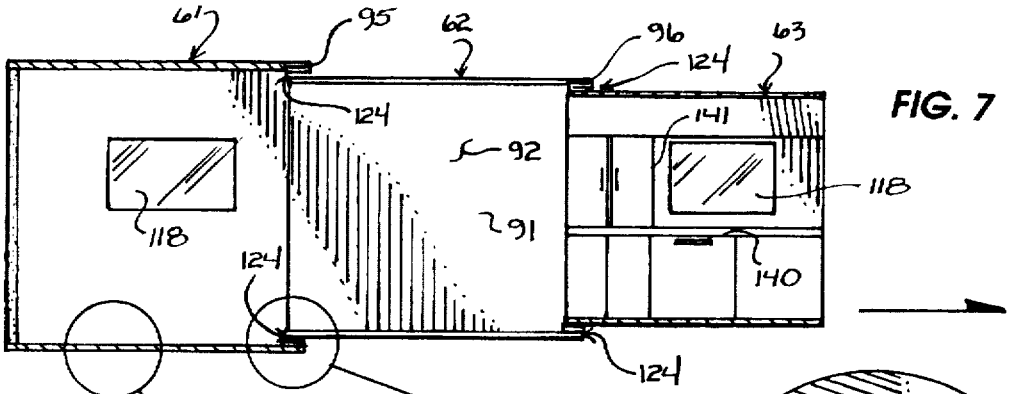
FIG. 7
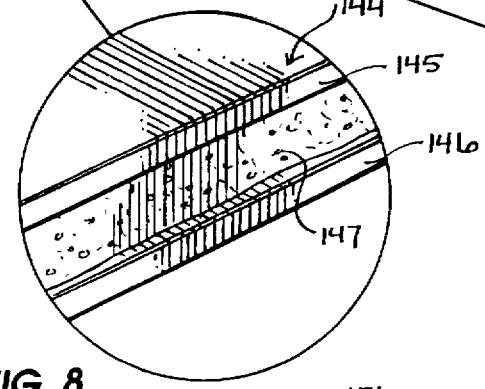
FIG. 8
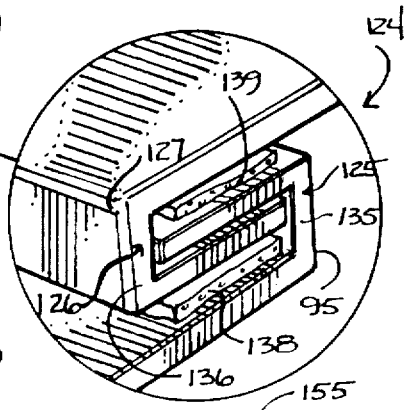
FIG. 9
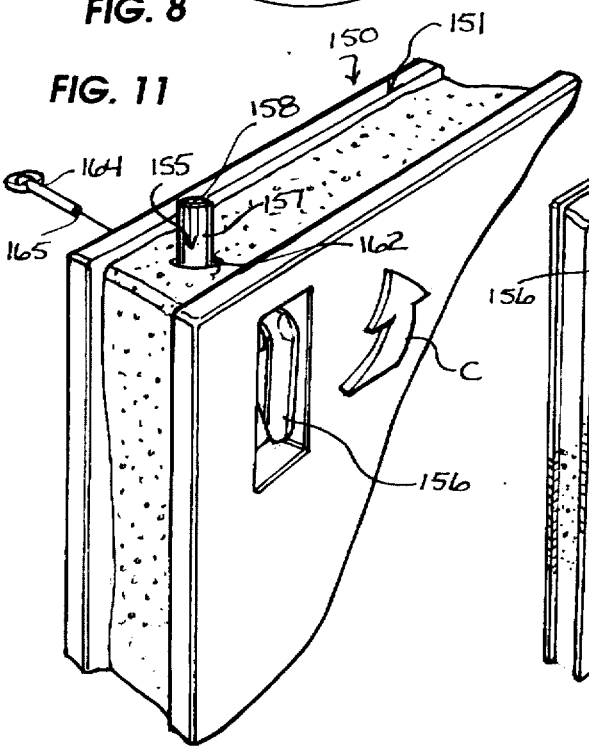
FIG. 11
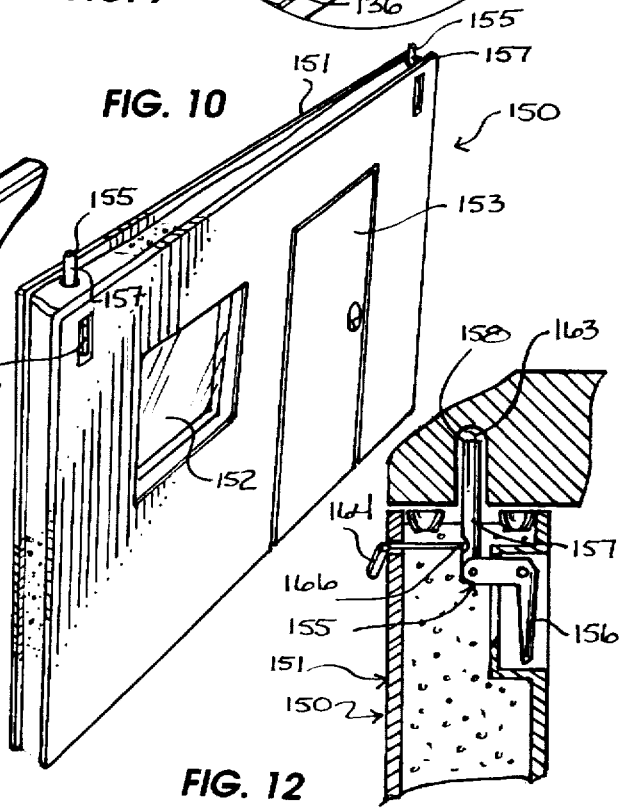
FIG. 10
FIG. 12

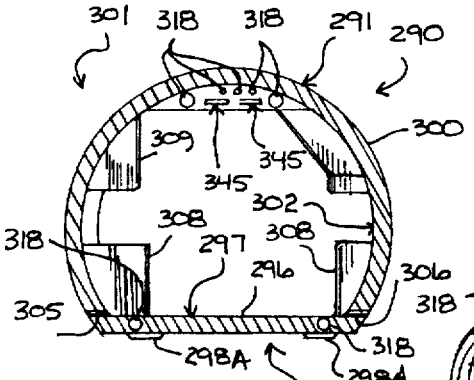
FIG. 25
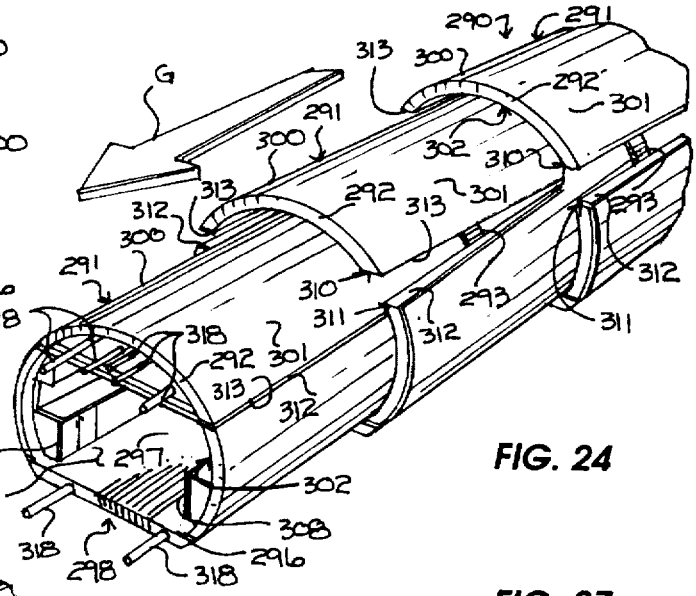
FIG. 24
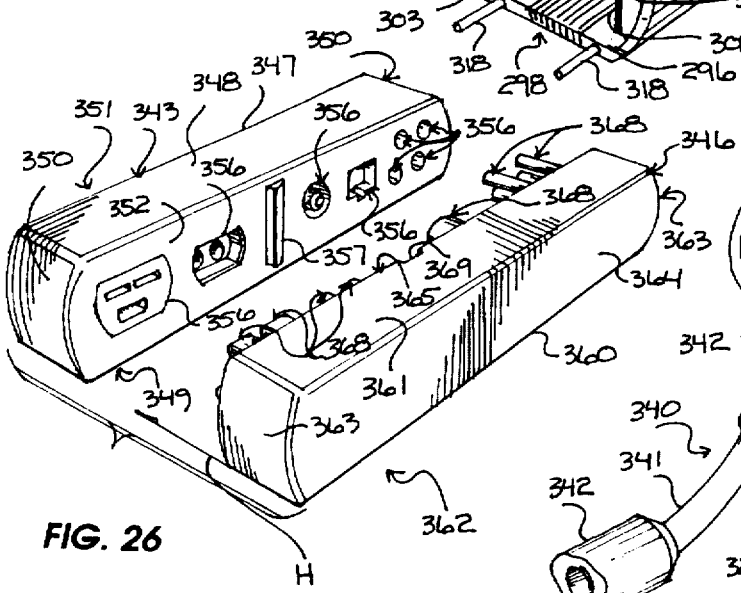
FIG. 26
FIG. 27
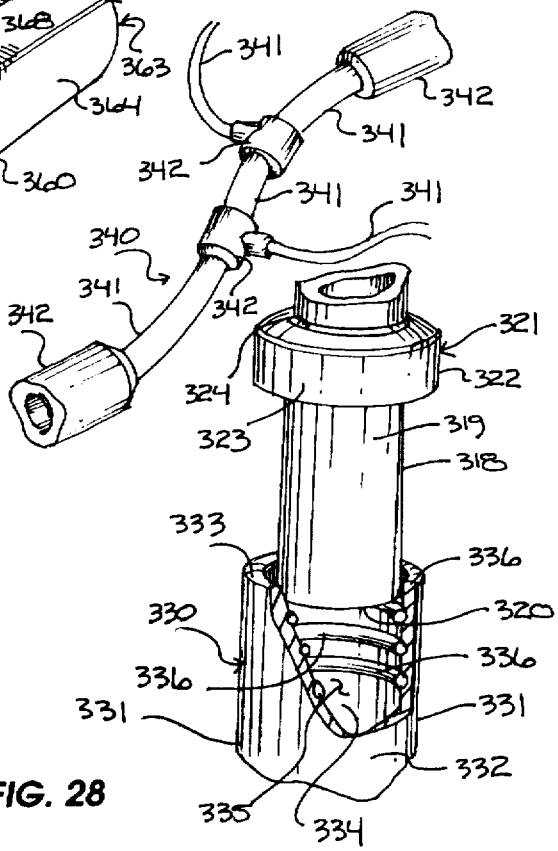
FIG. 28

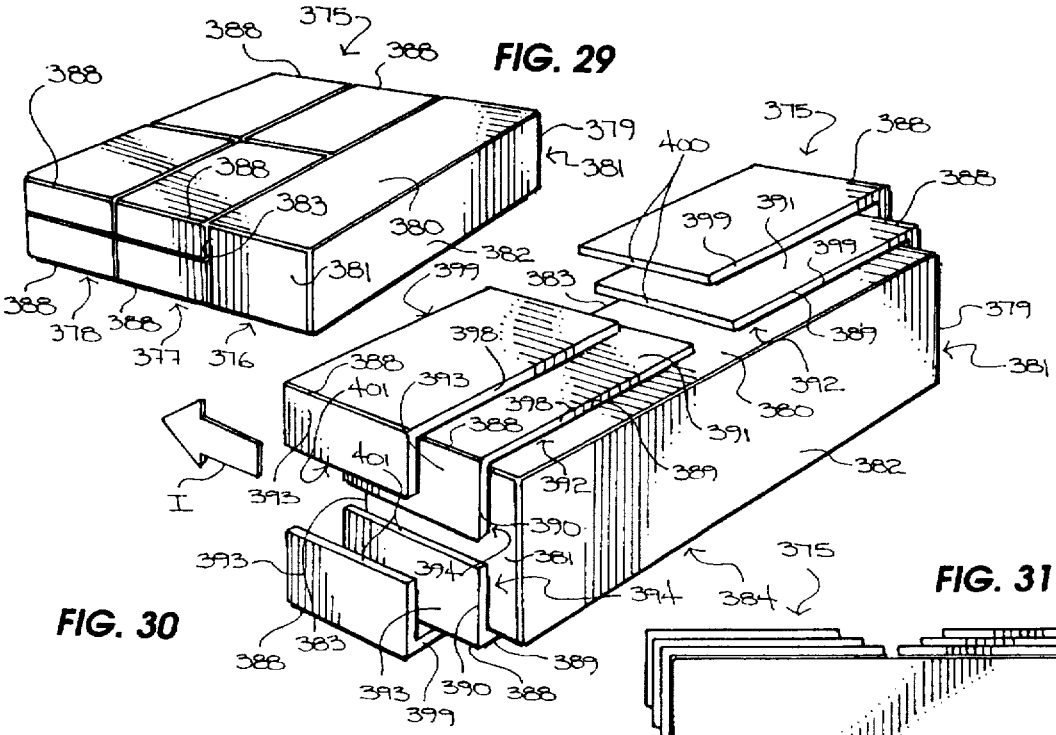
FIG. 29
FIG. 30
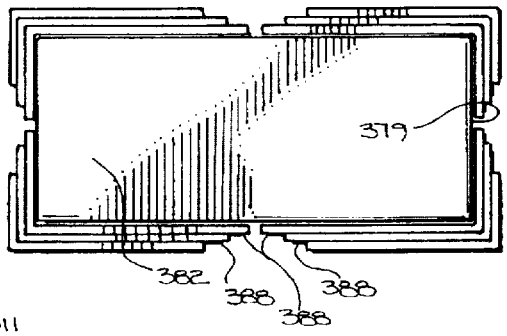
FIG. 31
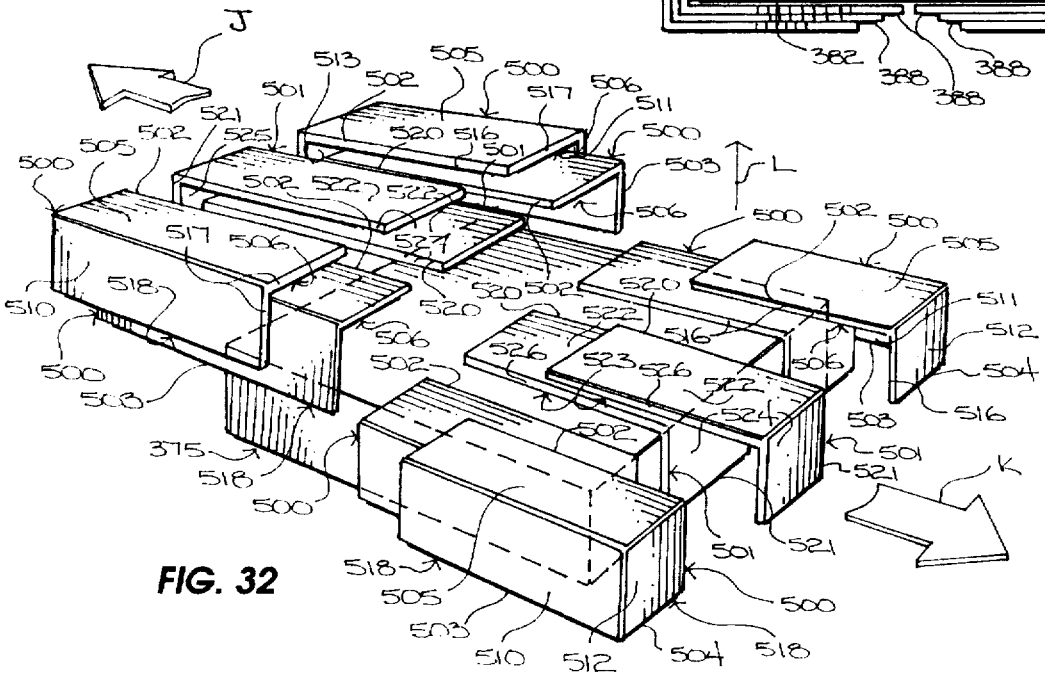
FIG. 32

FIG. 33
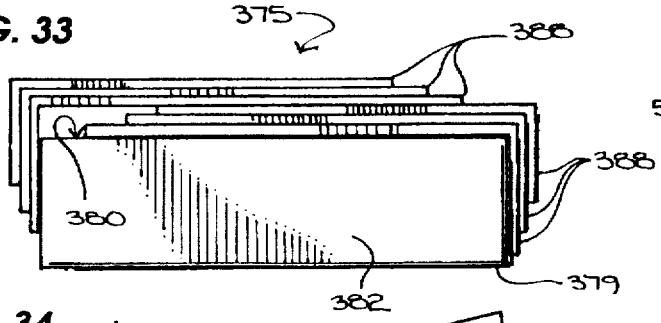
FIG. 34
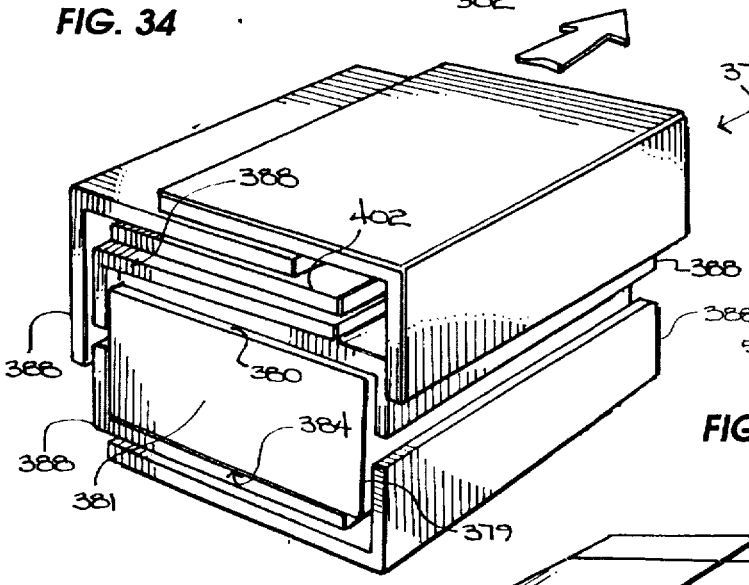
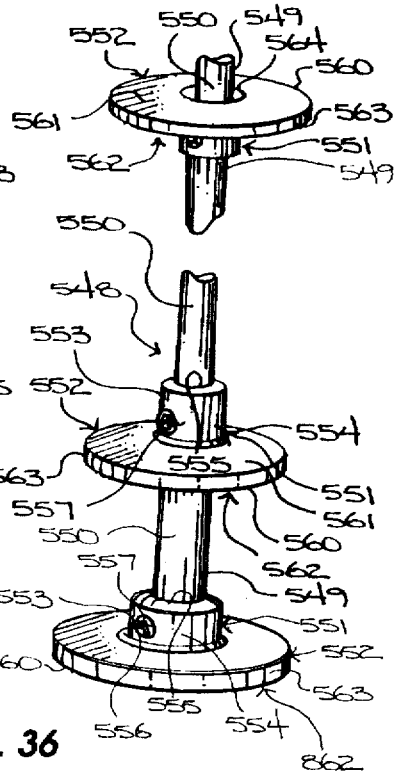
FIG. 36
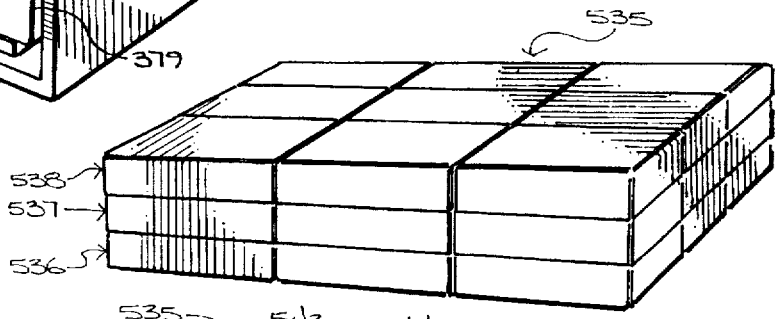
FIG. 35
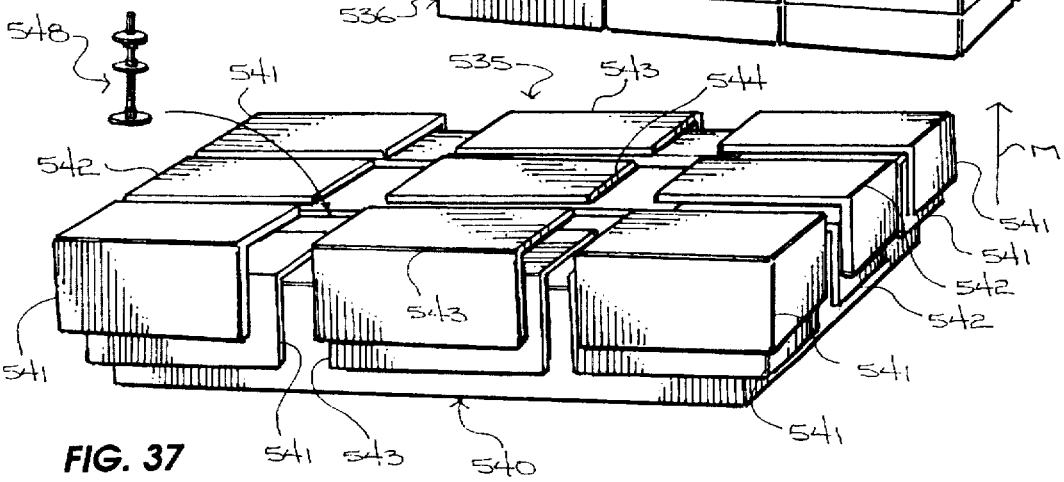
FIG. 37

PREFABRICATED EXPANDABLE ARCHITECTURE AND METHOD OF MAKING

BACKGROUND OF THE INVENTION

1. Field of the Invention

This invention relates to the art of architecture.

More particularly, this invention relates to prefabricated architectures.

In a further and more specific aspect, the instant invention relates to a prefabricated architecture expandable or extendible between a first configuration encompassing a first volume, and a second configuration encompassing a second larger volume.

2. Prior Art

The concept and practice of prefabrication, the assembly of buildings or their components at a location other than the building site, has been in existence for centuries. The modern sense of prefabrication, however, dates from the early 1900's. In accordance with the massive building activity existent throughout the modern world, massive prefabricated building elements have come to be staples in the world of construction.

Prefabrication is an ideal method for controlling construction costs because it economizes time, wages, and materials. Prefabricated units may include doors, stairs, window walls, wall panels, floor panels, roof trusses, room-sized components, and even entire buildings.

With respect to institutional and office buildings and works of civil engineering, such as bridges and dams, rigid frameworks or steel are normally prefabricated. The skins or large buildings are often modular units of porcelainized steel. Stairwells are delivered in prefabricated steel units. Raceways and ducts for electrical wiring, plumbing, and ventilation are built into the metal deck panels used in floors and roofs.

Prefabrication is also seen in concrete components. For instance, typical prefabricated concrete components may include slabs, beams, stairways, modular boxes, and even kitchens and bathrooms complete with precast concrete fixtures.

The specific benefits of prefabricated building components are that they can be mass-produced in an assembly line, constructed in a shorter period of time and for lower costs than similar elements fabricated by highly paid skilled laborers at a building site. Additionally, many contemporary building components also require specialized equipment for their construction that cannot be efficiently and economically moved from one building site to another. However, savings in material costs and assembly time may be facilitated by locating the prefabrication operation at a permanent building site.

The disadvantages inherent with the using of separate prefabricated structural elements used for the construction of large structures such as buildings, bridges, and other such type architectures, is that they tend to be bulky, cumbersome, and heavy. As a result, they tend to be difficult to transport, and similarly difficult to manipulate at the building site, which normally leads to a labor intensive and sometimes dangerous effort to fit various prefabricated structural elements or segments together.

On a smaller scale, prefabricated structures have been widely used for less permanent structures such as mobile hospitals and the like used by the armed forces and other relief organizations such as the Red Cross. These prefabricated structures may be easily transported to a selected site and erected in a relatively short period of time. Additionally, these structures may also be easily disassembled and transported to a different site.

When transported from one location to another, these inherently mobile prefabricated structures may be collapsible into a relatively small and compact configuration. Therefore, it is normally necessary to transport auxiliary items such as medical equipment, fixtures, and various types of furniture or other items, to be used within the prefabricated structure when erected, in a separate facility apart from the prefabricated structure itself. As a consequence, these auxiliary items must constantly be moved to and from the prefabricated structure with the movement of the prefabricated structure to various selected locations. This can not only be time consuming and labor intensive, but terribly inconvenient and frustrating.

Therefore, upon close examination of these prior art prefabricated structures and structural elements or segments, certain notable deficiencies inherent therein occasion the necessity of new and useful improvements.

It would be highly advantageous, therefore, to remedy the foregoing and other deficiencies inherent in the prior art.

Accordingly, it is an object of the present invention to provide a prefabricated expandable architecture.

Another object of the present invention is to provide a prefabricated expandable architecture that is easy and inexpensive to manufacture.

And another object of the present invention is to provide a prefabricated expandable architecture that is easy to transport.

Still another object of the present invention is to provide a prefabricated expandable architecture that is easy to assemble.

Yet another object of the instant invention is to provide a prefabricated expandable architecture having a first volume in a first configuration, and a second larger volume in a second configuration.

Yet still another object of the instant invention is to provide a prefabricated expandable architecture that may hold auxiliary items such as fixtures and furniture during transport from one location to another.

And a further object of the invention is to provide a prefabricated expandable architecture that is easy to disassemble.

Still a further object of the immediate invention is to provide a prefabricated expandable architecture that is strong, light, and resilient.

Yet a further object of the invention is to provide a prefabricated expandable architecture that may be easily expanded and retracted.

And still a further object of the invention is to provide a prefabricated expandable architecture that may be hermetically sealed.

A further object of the instant invention is to provide a method of making a prefabricated expandable architecture.

And a further object of the instant invention is to provide a prefabricated expandable architecture that may be easily transported and used in outer space.

And yet still a further object of the instant invention is to provide a prefabricated expandable architecture that floats on water.

Yet a further object of the instant invention is to provide a prefabricated expandable architecture that may be deployed substantially anywhere on level ground without preparation.

And still a further object of the instant invention is to provide a prefabricated expandable architecture that can accomodate a variety of floor plans by moveable wall segments.

Still a further object of the instant invention is to provide a prefabricated expandable architecture that can be deployed very quickly and easily.

SUMMARY OF THE INVENTION

Briefly, to achieve the desired objects of the instant invention in accordance with a preferred embodiment thereof, provided is a prefabricated expandable architecture and a method of making a prefabricated expandable architecture. The prefabricated expandable architecture includes a plurality of structural segments having a first volume in a first collapsed configuration, and a second larger volume when expanded or extended in a second configuration. In the second configuration, the plurality of structural segments may be rigidly and hermetically coupled together to form a rigid architecture having a selected shape such as generally pyramidal, or generally rectangular, or generally cylindrical, or other desired and selected configuration or shape.

A method of making a prefabricated expandable architecture includes providing a plurality of structural segments having a first volume in a first configuration and a second larger volume in a second configuration. The method further includes expanding or extending the structural segments in the second configuration and rigidly coupling the structural segments together thereby forming a substantially rigid structure or architecture having a predetermined shape.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 4 is a reduced perspective view of the embodiment shown in FIG. 1, and further illustrating the embodiment as it would appear in a collapsed configuration encompassing a first volume;

FIG. 5 is a reduced perspective view very similar to the view of FIG. 1;

FIG. 6 is an enlarged side elevational view of an embodiment of the instant invention very similar to the view of FIG. 4;

FIG. 7 is a side sectional view of an embodiment of the instant invention very similar to the embodiment illustrated in FIG. 1;

FIG. 8 is an enlarged fragmentary view of portions of the embodiment shown in FIG. 7;

FIG. 9 is an enlarged fragmentary view of an engagement pair used in combination with the embodiment shown in FIG. 7;

FIG. 10 is a perspective view of a partition member;

FIG. 11 is a partially exploded enlarged perspective fragmentary view of portions of the partition member illustrated in FIG. 10, and further illustrating details of an engagement member;

FIG. 12 is an enlarged side sectional view of the engagement member taken along line 11—11 of FIG. 11, and further illustrating portions of the engagement members as it would appear in use with a complemental engagement element;

FIG. 24 is a fragmentary perspective view of still another alternate embodiment of the instant invention;

FIG. 25 is a sectional view taken along line 24—24 of FIG. 24;

FIG. 26 is an enlarged perspective view of a pair of plug members;

FIG. 27 is an enlarged fragmentary perspective view of portions of a piping matrix;

FIG. 28 is an enlarged fragmentary perspective view of a pipe member shown in cooperation with a fitting element, portions of said fitting element being broken away for the purpose of illustration;

FIG. 29 is a perspective view of yet still a further alternate embodiment of the instant invention;

FIG. 30 is an enlarged perspective view of a plurality of structural segments used in combination with the embodiment illustrated in FIG. 29 and further shown in a collapsed configuration;

FIG. 31 is a side elevational view of the plurality of structural segments used in combination with the embodiment illustrated in FIG. 30 and further shown in a collapsed and nested configuration;

FIG. 32 is an exploded perspective view of structural segments cooperable with the embodiment depicted in FIG. 29;

FIG. 33 is a side elevational view of an alternate configuration of how the plurality structural segments shown in FIG. 31 may be nested together;

FIG. 34 is an enlarged perspective view of yet still another alternate way of nesting the plurality of structural segments shown in FIG. 33;

FIG. 35 is a perspective view of an alternate embodiment of the instant invention;

FIG. 36 is an enlarged fragmentary view of a support member;

FIG. 37 is perspective view of the alternate embodiment shown in FIG. 36, and further illustrating the embodiment as it would appear in a partially collapsed configuration with a support member, such as the one illustrated in combination with FIG. 37, shown proximate thereto;

DETAILED DESCRIPTION OF THE PREFERRED EMBODIMENT

Figures 1, 2, 3:
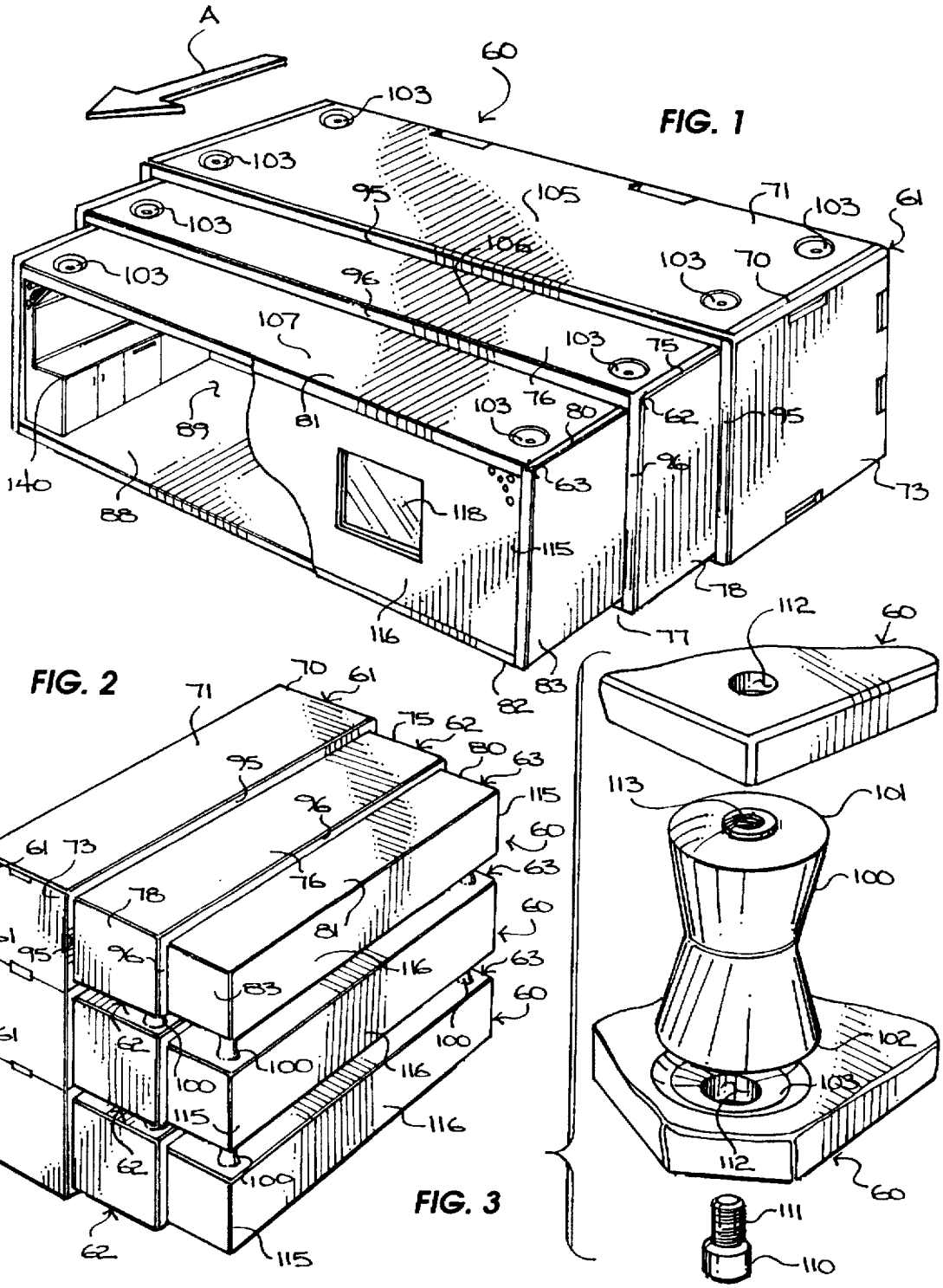
FIG. 1 is a perspective view of an embodiment of the instant invention constructed in accordance with the preferred embodiment, with portions therein broken away for the purposes of illustration.
FIG. 2 is a reduced perspective view of three of the embodiments shown in FIG. 1, and further illustrating the three embodiments as they would appear stacked on top of one another, and still further illustrating resilient spacer elements disposed therebetween.
FIG. 3 is an enlarged exploded perspective view of a resilient spacer element illustrated in FIG. 2.

Turning now to the drawings, in which like reference characters indicate corresponding elements throughout the several views, attention is first directed to FIG. 1 which illustrates a first embodiment of the instant invention comprising a prefabricated expandable architecture being generally designated by the reference character 60. The prefabricated expandable architecture 60 illustrated in FIG. 1 includes a plurality of structural segments specifically including a front structural segment 61, an intermediate structural segment 62, and a rear structural segment 63, shown in telescoping relationship respectively.

With additional reference to FIG. 1, FIG. 2, which illustrates three prefabricated expandable architectures 60 stacked one atop another, and FIG. 5, the front structural segment 61 includes a continuous sidewall 70 generally formed in the shape of a rectangle. The continuous sidewall 70 includes a top panel 71, a bottom panel 72, and two side panels 73, all integrally connected. Like the front structural segment 61, the intermediate structural segment 62 also includes a continuous sidewall 75 generally formed in the shape of a rectangle defined by a top panel 76, a bottom panel 77, and two side panels 78, all integrally connected. And finally, the rear structural segment 63 similarly includes a continuous sidewall 80 generally formed in the shape of a rectangle defined by a top panel 81, a bottom panel 82, and two side panels 83, all integrally connected. As can be seen in FIG. 1 and FIG. 5, a continuous inner surface 85 of the continuous sidewall 70 of the front structural segment 61 defines a front volume 86, and a continuous inner surface 88 of the continuous sidewall 80 of the rear structural segment 63 defines a rear volume 89. Further more, as can be seen in FIG. 7, a continuous inner surface 91 of the continuous sidewall 75 of the intermediate structural segment 62 defines an intermediate volume 92.

With reference to FIG. 1 and FIG. 5, in combination with FIG. 4 and FIG. 6, the front, intermediate, and rear, structural segments of the prefabricated expandable architecture 60 are telescopingly movable from a first configuration, of which is illustrated in FIG. 4 and FIG. 6, and a second configuration which is illustrated in FIG. 1 and FIG. 5. In the first configuration, each structural segment is shown as telescopingly collapsed encompassing a first volume defined as the rear volume 89 of the rear structural segment 63, the rear volume 89 of which would of course be the inside of the prefabricated expandable architecture 60. In the second configuration, the front, intermediate, and rear structural segments are shown as telescopingly expanded or extended resulting from the telescoping movement of the structural segments in the direction indicated by arrow A in FIG. 1 and arrow B in FIG. 5. In the second configuration the prefabricated expandable architecture 60 is expanded and the inside of the prefabricated expandable architecture 60 is shown as encompassing a second larger volume defined as the combination of the front volume 86 of the front structural segment 61, the intermediate volume 92 of the intermediate structural segment 62, and the rear volume 89 of the rear structural segment 63.

As can be seen from the above referenced figures, the front structural segment 61 includes a peripheral rim 95 defining an open end into which is disposed in telescoping relation an end or portions of the intermediate structural segment 62. Additionally, the intermediate structural segment 62 also includes a peripheral rim 96 defining an open end into which is disposed in telescoping relation an end or portions of the rear structural segment 63. It will be appreciated by those of ordinary skill in the art, that in order to achieve the telescoping relationship depicted in the drawings, the front structural segment 61 must have at least one open end for telescopingly receiving the intermediate structural segment 62. Additionally, the intermediate structural segment 62 must also include at least one open end for telescopingly receiving the rear structural segment 63.

Although the front structural segment 61, the intermediate structural segment 62, and the rear structural segment 63, have been herein described as being generally rectangular, it will be readily appreciated by those or ordinary skill that the generally rectangular configuration has been disclosed merely for the purpose of illustration and for the purpose of disclosing a preferred embodiment, and that any preferred configuration suitable for use in combination with the instant invention may be incorporated in lieu thereof. Additionally, it will be further appreciated by those of having ordinary skill that any desired number of structural segments may be used in combination with the instant invention for creating a structure or architecture of a selected and desired size.

With continuing reference to FIG. 2, it is again noted that a plurality of prefabricated expandable architectures 60 may be selectively and desirably stacked one atop another to form an architecture encompassing a selected volume. Disposed between portions of the prefabricated expandable architectures 60 are seen a plurality of upstanding resilient compliant columns 100. Each compliant column 100 may be constructed of any suitable compliant material such as silicone rubber, or other suitable resilient and compliant material, and functions as a spacing element or spacing means for selectively spacing the telescoping portions of the prefabricated expandable architecture 60 apart from one another. Additionally, due to the compliant nature of each compliant column 100, the compliant columns also function as a compliant stabilizing means or a shock absorption system for absorbing seismic shocks from an earthquake, or for absorbing other like external forces likely to otherwise cause destabilization of the prefabricated expandable architectures 60 stacked in such a way indicated in FIG. 2.

With specific reference to FIG. 3 and FIG. 1, each compliant column 100 includes a top end 101 and a bottom end 102, both receivable in recessed portions 103 formed selectively on surfaces of the top and bottom panels of the front, intermediate, and rear structural segments, 61, 62, and 63 respectively. FIG. 1, FIG. 4 and FIG. 5 illustrate the recessed portions 103 as formed on the outer surfaces, 105, 106, and 107, of the top panels, 71, 76, and 81, of the front, intermediate, and rear structural segments, 61, 62, and 63 respectively. However, although not herein specifically shown, the recessed portions 103 may also be formed on portions of the outer surfaces of the bottom panels of the front, intermediate, and rear structural segments to facilitate placement of the compliant columns as shown in FIG. 2.

As can be seen with continuing reference to FIG. 3, each compliant column 100 may be secured in the recessed portions 103 by means of a bolt 110 having a threaded portion 111 receivable through aperture 112 formed through selected portions of a selected structural segment and threadably received into a threaded aperture 113 formed in the selected compliant column 103. The bolt 110 and the threaded aperture 113 constitute and element and a complemental element respectively of an engagement pair for engaging a selected compliant column 103 to portions of the prefabricated expandable architecture 60. It will be readily appreciated by those of ordinary skill that although the herein described engagement pair has been specifically illustrated as being a bolt 110 threadably receivable into a threaded aperture 113 proximate the compliant column 100, any preferable and suitable engagement means may by used in lieu thereof.

Additionally, as can be seen from FIG. 1 and FIG. 2, each rear structural segment 63 shown is shown as having a second closed end 115 defined by end panel 116. It will be appreciated, however, that the second closed end 115 of each rear structural segment 63 shown need not necessarily be closed. With additional reference to FIG. 6, the end panel 116 making up the second closed end 115 of the rear structural segment 63 is shown as having one or more window portions 118 formed therethrough for facilitating visual access into the prefabricated expandable architecture 60. It will be readily appreciated by one of ordinary skill in the art that the window portions illustrated are shown merely for the purpose of illustration and need not be present in combination with the instant invention. Furthermore, if desirable, one or more window portions may be selectively and desirably formed not only in combination with the second closed end 115 of the rear structural segment 63, but anywhere along suitable portions of the prefabricated expandable architecture as herein specifically desired.

Reference is now directed to FIG. 7, which illustrates the front structural segment 61, the intermediate structural segment 62, and the rear structural segment 63 telescopingly extended to form the second configuration. As can be seen with additional reference to FIG. 9, when the intermediate structural segment 62 is telescopingly extended relative the front structural segment 61, an element 125 of an engagement pair 124 proximate the peripheral rim 95 of the front structural segment 61 becomes engaged with a complemental element 126 of the engagement pair 124 proximate an inner end 127 of the intermediate structural segment 62 for inhibiting further movement of the intermediate structural segment 62, and for coupling the intermediate structural segment 62 to the front structural segment 61. Similarly, when the rear structural segment 63 is telescopingly extended relative the intermediate structural segment 62, the same element 125 of the engagement pair 124 proximate the peripheral rim 96 of the intermediate structural segment 62 becomes engaged with the same complemental element 126 of the engagement pair 124 proximate an inner end 128 of the rear structural segment 62 for inhibiting further movement of the rear structural segment 63, and for coupling the rear structural segment 63 to the intermediate structural segment 61.

With specific reference to FIG. 9, illustrated is a preferred embodiment of the engagement pair 124 referenced with respect to FIG. 7. Specifically, the element 125 of the engagement pair 124 is shown as comprising a substantially rigid generally L-shaped retaining flange 135 engagable with an opposing substantially rigid generally L-shaped retaining flange 136 comprising the complemental element 126. With respect to the preferred embodiment thereof, each element 125 and complemental element 126 of each engagement pair 124 described in combination with FIG. 7, are desirably continuous for facilitating even and substantial engagement of the structural segments when disposed in the second configuration. Further shown in FIG. 9 is seen a hermetic seal system consisting of continuous sealing elements, 138 and 139, disposed in combination with the element 125 and the complemental element 126 respectively of the engagement pair 124. The sealing elements are preferably constructed of a hermetically sealable substrate. The hermetically sealable substrate may be heated to a selected and desired temperature sufficient to cause the hermetically sealable substrate to flux or become somewhat fluid-like for allowing the hermetically sealable substrate to flow about the engagement pair 124. Upon removing heat from or cooling the hermetically sealable substrate, the hermetically sealable substrate solidifies thereby forming a hermetic seal between the element 125 and the complemental element 126 of the engagement pair.

It will be readily appreciated by those having ordinary skill in the art that any preferred and suitable engagement means may be used in lieu of the engagement pair 124 herein specifically described, and that any preferred and suitable hermetic sealing system may also be used that is consistent with the dynamics of the instant invention.

Reference is now directed to FIG. 8, which illustrates a sectional view of a portion of the bottom panel 71 of the front structural segment 61. As can be seen, bottom panel 71 consists of a stress skin panel 144 comprising an inner sheath 145 and an outer sheath 146, with an insulating material 147 sandwiched therebetween. Preferably, the front structural segment 61, the intermediate structural segment 62, and the rear structural segment 63 are all constructed of the same stress skin panel 145, which is a substantially light and resilient construction or composition that provides structural rigidity and support for the prefabricated expandable architecture 60. It will be noted that the inner sheath 145 and the outer sheath 146 may be constructed of any preferred substantially rigid and resilient material such as plastic, a type of metal, a ceramic type material, a material impervious to the exposure of water or the extreme conditions present respecting space travel, or some other preferred and suitable material. Additionally, the insulating material 147 may be desirably constructed of polystyrene foam or any other preferred and suitable material.

In light of the foregoing discussion, it will be noted that in the collapsed configuration or the first configuration, the prefabricated expandable architecture 60 is substantially compact and may be easily transported upon portions of a moving truck, a plane, or even suitably disposed in combination with a space vehicle such as a space shuttle for transport and deposit into an orbital orientation above the Earth. In orbit above the Earth, the prefabricated expandable architecture may be selectively disposed in the second configuration, and then the engagement pairs hermetically sealed for producing a hermetically sealed system, and perhaps even pressure tight, for retaining an internal environment in the second larger volume capable of sustaining human life upon the introduction of breathable air and temperature control and other necessary and selected environmental controls. Additionally, as can be seen in FIG. 1 and FIG. 7, the rear structural segment 63 may include fixtures or storage units coupled to inner surface 88 such as cabinets 140 and cupboards 141 for holding selected items.

In order to sustain a hermetically sealed system, the prefabricated expandable architecture must be a closed system, such that the second larger volume is encompassed by the front, intermediate and rear structural segments thereby insulating the second larger volume, and the first larger volume for that matter, from an external environment. Additionally, in such a closed system, it of course would be necessary to provide an access means for accessing the inside of the prefabricated expandable architecture. Although not herein specifically shown, it will be appreciated by one having ordinary skill in the art, that such an access means may comprise a door or other similar access port suitably incorporated therewith.

Reference is now drawn to FIG. 10, FIG. 11, and FIG. 12, which illustrates a partition wall 150. The partition wall 150 includes a panel 151 having the same construction as the stress skin panel 144 described in combination with FIG. 8. The partition wall further includes a window portion 152 and a door 153 which may be selectively closed or opened for enabling access therethrough. The partition wall 150 may be selectively disposed inside the prefabricated expandable architecture 60 as herein described for selectively partitioning the inside volume of the prefabricated expandable architecture 60. It will be appreciated that the partition wall 150 may be used for creating a desired configuration of separate room areas within the prefabricated expandable architecture 60. Additionally, any desired and suitable number of partition walls may be selectively and desirably incorporated in combination with the instant invention.

As can be seen, the partition wall 150 shown in FIG. 10 includes two engagement members 155, each of which comprise an element of an engagement pair. Each engagement member 155, details of which can be seen in FIG. 12, includes a latch member 156 coupled to an end of a substantially rigid elongate member 157 which terminates with a free end 158 extending through an aperture 162 formed through portions of the partition wall 150. The latch member 156 is coupled to the elongate member 157 in such a way that upon movement of the latch member 156 in the direction indicated by arrow C in FIG. 10, the free end 158 of the elongate member 157 recedes into the aperture 162 in a first position, and upon movement of the latch member 156 in the opposite direction, the free end 158 of the elongate member 157 then moves outwardly through the aperture 162 thereby becoming exposed in a second position. The free end 158 of the elongate member 157 may be selectively disposed into a complemental element of the engagement pair which is herein shown as a recessed portion 163, of which may be formed proximate the inner surface of one of the structural segments, for fixedly retaining the partition wall 150 in a selected position inside the prefabricated expandable architecture 60. Additionally, once the elongate member 157 is disposed into the recessed portion 163, or otherwise is exposed from the aperture 162 in the second position, a locking pin 164 may be inserted through portions of the partition wall 150 for engaging a free end 165 of the locking pin 164 with a recessed portion 166 formed on the elongate member 157. This serves as a locking means for locking the engagement member 155 in a fixed position.

It will be readily appreciated that although two engagement members 155 have been shown in combination with the above referenced drawings, of which both were shown merely for the purpose of illustration with respect to a preferred embodiment, any selected and desired and suitable number of engagement members 155 may be used. Additionally, as has been herein specifically described, the engagement members 155 illustrate a means for selectively and detachably securing or engaging the partition wall 150 to portions of the prefabricated expandable architecture 60. However, it will be readily appreciated that any selected and suitable engagement means may be used in combination with the partition walls in lieu thereof.

Figures 13, 14, 15, 16, 17, 18:
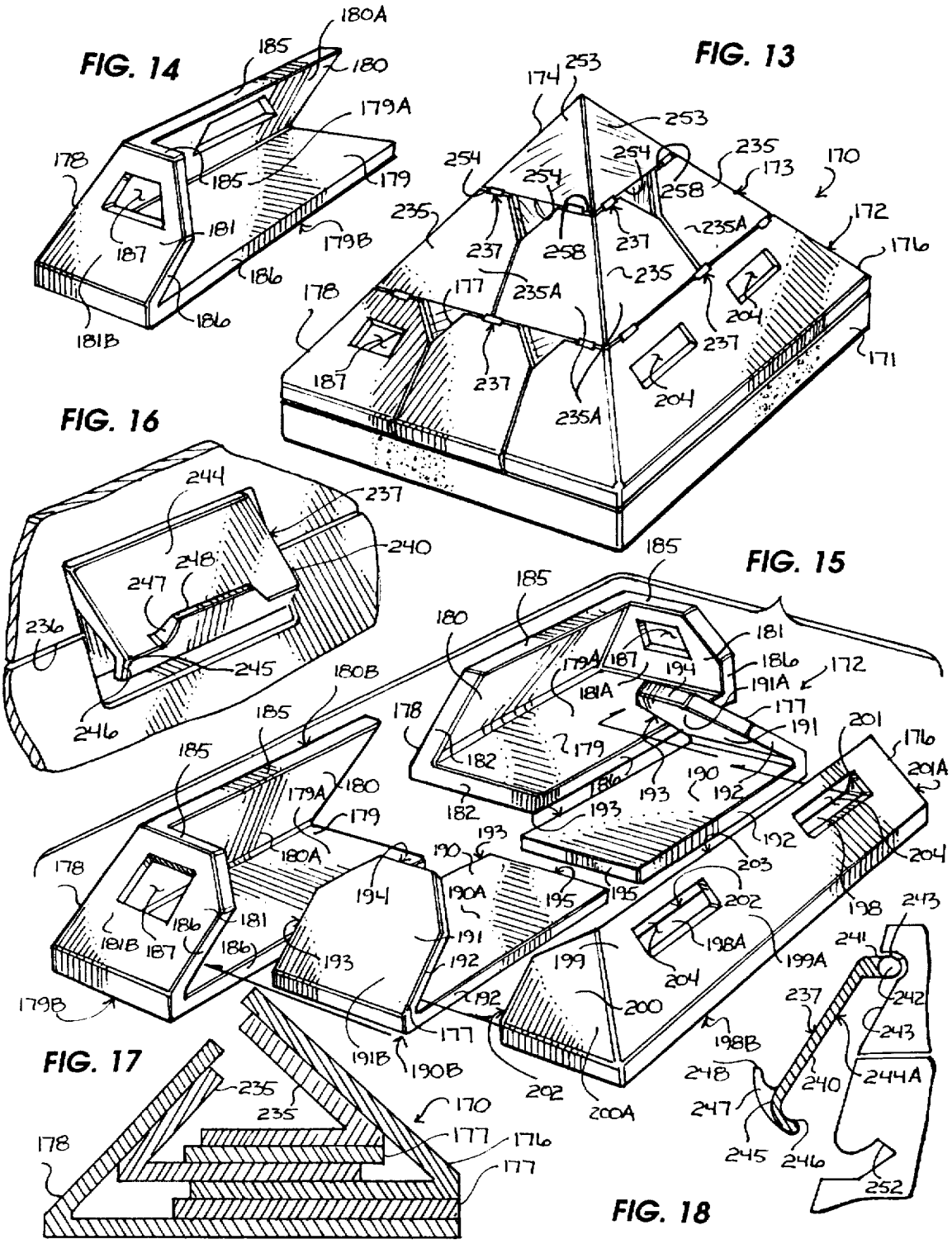
FIG. 13 is a perspective view of an alternate embodiment of the instant invention.
FIG. 14 is an enlarged perspective view of one of a plurality of structural segments used in combination with the embodiment shown in FIG. 13.
FIG. 15 is an enlarged exploded perspective view of a selected number of the plurality of structural segments used in combination with the embodiment shown in FIG. 13.
FIG. 16 is an embodiment of an engagement pair used in combination with the embodiment shown in FIG. 13.
FIG. 17 is a sectional view of the plurality of structural segments used in combination with the embodiment shown in FIG. 13, and further illustrating the structural segments as they would appear stacked or nested together.
FIG. 18 is an enlarged side sectional view of the engagement pair taken along line 16—16 of FIG. 16.
Figure 20:
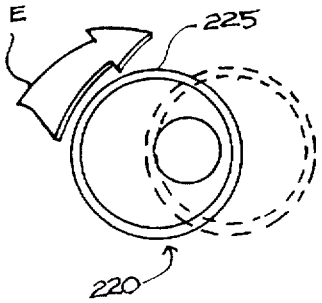
FIG. 20 is a sectional view of the camming bolt taken along line 19—19 of FIG. 19.

Reference is now directed to FIG. 13 which illustrates an alternate embodiment of a prefabricated expandable architecture being generally designated by the reference character 170. Illustrated is a plurality of prefabricated structural puzzle segments that are coupled together to form a generally pyramid shaped structure encompassing a volume. As can be seen from FIG. 13, the prefabricated expandable architecture 170 is mounted upon a base or foundation 171, which may be constructed of any preferred material such as concrete or other suitable material.

With continuing reference to FIG. 13, and additional reference to FIG. 14 and FIG. 15, the structural puzzle segments have varying shapes and configurations such that when puzzled together in coupled relationship, a selected shape is thereby formed. Specifically, the prefabricated expandable architecture 170 shown includes a bottom floor portion, an upper floor portion, and a top portion. FIG. 15 illustrates the structural puzzle segments making up the bottom floor portion as they would appear separated from one another. The structural puzzle segments making up the bottom floor portion include a front structural segment 176, two intermediate structural segments 177, and two rear structural segments 178. Each of the rear structural segments 178 include a substantially flat bottom panel 179 having two upwardly extending sidewalls, 180 and 181. The bottom panel 179 includes in inner surface 179A and an outer surface 179B. Additionally, the upwardly extending sidewalls, 180 and 181, each include an inner surface, 180A and 181A, and an outer surface, 180B and 181B, respectively. The rear structural segments 178 also include an inner edges 182, an upper edge 185, a bottom edge 186, and a window portion 187. The intermediate structural segments 177 include a substantially flat bottom panel 190 having an upwardly extending sidewall 191, two side edges, 192 and 193, an upper edge 194, and an inner edge 195. Each bottom panel 190 includes an inner surface 190A and an outer surface 190B, and each sidewall 191 includes an inner surface 191A and an outer surface 191B. Finally, the front structural segment 176 includes a substantially flat bottom panel 198 having three upwardly extending sidewalls, 199, 200, and 201, an inner edge 202, an upper edge 203, and two window portions 204. Sidewalls 199, 200, and 201, each include an outer surface, 199A, 200A, and 201A respectively, and each an inner surface (of which are not herein specifically shown). Additionally, the bottom panel 198 includes an inner surface 198A, and an outer surface 198B.

The plurality of puzzle segments each include mating edges that may be matingly engagable to one another to form the generally pyramid structure or architecture shown in FIG. 13. Specifically, the front structural segment 176, the two intermediate structural segments 177, and the two rear structural segments 178 which comprise corner members, are all connectable to form the bottom floor portion 172. In particular, the inner edges 182 of the rear structural segments 178 may be brought together in a mating relationship. Similarly, the inner edges 195 of the intermediate structural segments 177 may be brought together in mating relationship. The side edges 193 of the intermediate structural segments 177 may then be brought together in mating relationship with the bottom edges 186 of the rear structural segments 178. In order to complete the assembly of the bottom floor portion 172, the inner edge 202 of the front structural segment 176 may then be brought together in mating relationship with side edges 192 of the intermediate structural segment 177.

Figure 22:
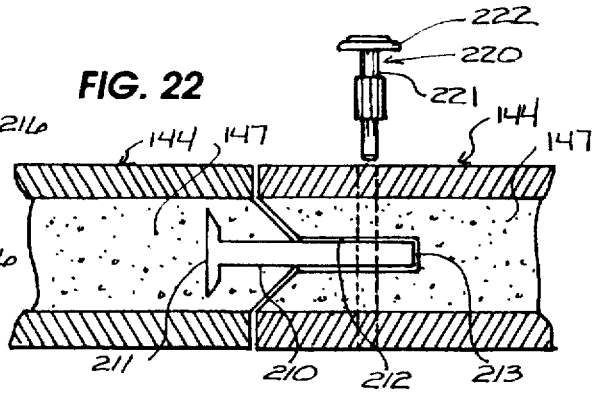
FIG. 22 is an enlarged fragmentary sectional view of the engagement pair taken along line 21—21 of FIG. 21, and further illustrating the engagement pair engaged, with the camming bolt of FIG. 19 positioned proximate thereto for securing the engagement pair together.

Once the front structural segment 176, the intermediate structural segments 177, and the rear structural segments 178 are brought together as has been herein specifically described, it is desirable to rigidly and fixedly secure the segments together for providing the bottom floor portion as a cohesive substantially rigid floor element that is effectively hermetic. Once such rigid coupling means for rigidly coupling the structural segments together is illustrated in combination with FIG. 19, FIG. 20, FIG. 21, and FIG. 22. FIG. 22 illustrates an elongate tongue member 210, comprising an element of an engagement pair, having a headed end 211 coupled in the insulating material 147 proximate an edge of a stress skin panel 144. The tongue member 210 is preferably constructed of a substantially rigid material such as a type of metal, plastic, or other suitably substantially rigid material. Also shown is a groove 212, comprising a complemental element of the engagement pair, formed in the insulating material 147 proximate an edge of another stress skin panel 144. It will be appreciated that the edges the tongue member 210 is coupled to and the groove 212 is formed in FIG. 22 are preferably any one of the mating edges described in combination with the structural segments discussed with respect to the prefabricated expandable architecture illustrated in FIG. 13. The tongue member 210 includes a free end 213 that when disposed in the direction indicated by arrow D, becomes disposed into the groove 212 of which can be seen in FIG. 22. As can be seen, the tongue member 210 further includes a plurality of equally spaced apart apertures 215 that, once the tongue becomes disposed into groove 212, become desirably aligned with a plurality of opposing equally spaced apart apertures 216 formed through portions of the stress skin panel 144 proximate the groove 212.

Figure 19:
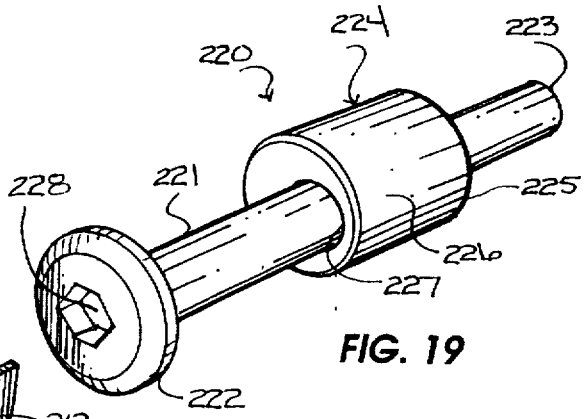
FIG. 19 is an enlarged perspective view of a camming bolt.
Figure 21:
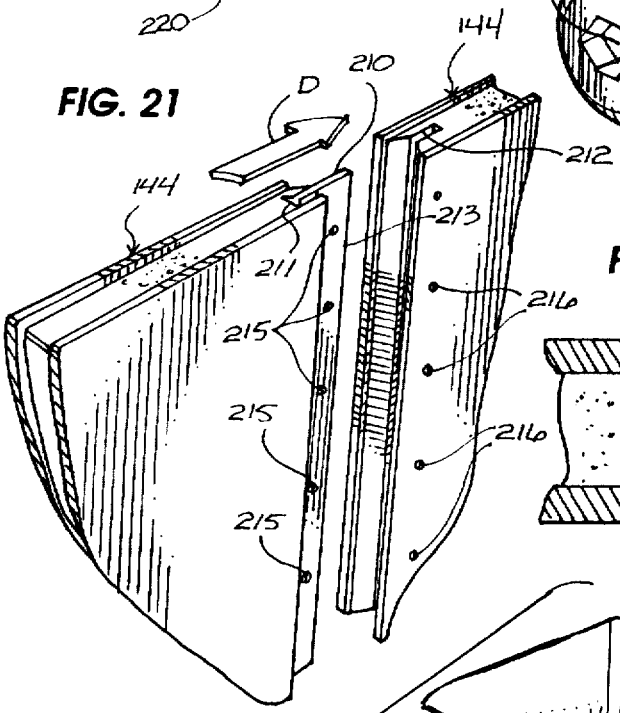
FIG. 21 is an enlarged fragmentary perspective view of an alternate embodiment of an engagement pair that may be used in combination with the embodiment illustrated in FIG. 13.

With reference to FIG. 19, illustrated is a camming element 220 including a generally cylindrical shaft 221 having a headed end 222 and a free end 223 with a camming member 224 coupled thereon at an intermediate position. The camming member 224 includes a generally cylindrical member 225 having a generally cylindrical outer surface 226, and a bore 227 offset from the central axis of the generally cylindrical member 225 and sized for receiving the shaft 221. The headed end 222 includes a recessed portion 228 formed therein for receiving an Allen wrench. It will be understood that camming member 224 may be constructed in a single structure, with an eccentric axis corresponding to bore 227 from which shaft 221 extends. The camming element 220 is receivable by aperture 215 and by aperture 216 enabling the camming member to become disposed within aperture 215 in the tongue member 210. Upon rotation of the camming element in the direction indicated by arrow E in FIG. 20, the camming member rotates within aperture 215 thereby imparting motion to the tongue member 210 for bearing the tongue member 210 against and within the groove 212 for snugly, securingly, and lockingly engaging the tongue member 210 to the groove 212. Thus, the camming element serves as a securing means for lockingly engaging the tongue member 210 to the groove 212.

The tongue member 210 and groove 212 engagement pair herein described constitute a preferred coupling means for rigidly securing one edge to another edge. It will be appreciated that such a rigid coupling means is desirably necessary for engaging the bottom edges 186 of the rear structural segments 178 to the side edges 193 of the intermediate structural segments 177, and for engaging the side edges 192 of the intermediate structural segments 177 to the inner edge 202 of the front structural segment 176. This configuration is desirable for producing a rigid and resilient bottom floor portion 172 which would in turn be capable of withstanding a substantial amount of weight and force without becoming compromised.

Consistent with the description of the bottom floor portion 172, the upper floor portion is constructed in much the same way. As can be seen in FIG. 13, the upper floor portion includes a plurality of corner segments 235, having outer surfaces 235A, which are coupled together in the same manner as the structural segments of the bottom floor portion, and will not herein be again described, and then placed on top of the bottom floor portion 172. However, interposed between lower edges 236 of the corner segments 235 and the upper edges 203, 194 and 185, of the front structural segment 176, intermediate structural segments 177, and the rear structural segments 178, respectively, are seen bracket portions 237 for fixedly and lockingly engaging the upper floor portion 173 to the bottom floor portion 172. With specific reference to FIG. 18, each bracket portion 237 includes a bracket member 240 having an end 241 hingedly attached to a hinging element 242 coupled to a recessed portion 243 suitably located proximate lower edge 236. The bracket member 240 further includes an outer surface 244, an inner surface 244A, and a free end 245 having an integrally attached inwardly extending hook member 246 extending therefrom. The bracket member 240 further includes an outwardly extending handle portion 247 suitably located proximate free end 245, and terminating with a free end 248. The hook member 246 is hingedly moveable and selectively engagable with a recessed portion 252 formed proximate a selected upper edge of the structural segments which form the bottom floor portion 172.

It will be appreciated that any number of a plurality of bracket portions 237 may be used in combination with the instant invention for detachably and selectively engaging the upper floor portion 173 to the bottom floor portion 172. Additionally, the bracket portions serve as a rigid coupling means for rigidly and selectively securing or coupling the upper floor portion 173 to the bottom floor portion.

With continuing reference to FIG. 13, disposed on top of the upper floor portion 173 are a plurality of window panels 253. Each window panel 253 has a lower edge 254 selectively and rigidly secured to upper edges 258 of the corner segments 235 by means of the bracket portion 237 herein described. Each window panel 253 includes side edges 259 which may be coupled together by means of any preferred manner, such as the tongue and groove engagement means discussed in combination with FIG. 21 and FIG. 22, or any other suitable manner. Once installed, the window panels 253 function as a skylight for allowing external light to emanate into the prefabricated expandable architecture 170, and for allowing visual access either therein or therefrom.

The window panels 253 may be constructed of any suitable and desired material such as glass, clear plastic, or some other type of material.

It will be understood that each of the structural puzzle segments herein described in combination with the prefabricated expandable architecture 170 include mating edges which are selectively engagable in mating relationship to form a preselected configuration or shape. Although the embodiment of the prefabricated expandable architecture 170 herein shown is generally formed in the shape of a pyramid, it will be readily appreciated by those having ordinary skill that any preferred and selected shape may be incorporated in lieu thereof such as square, rectangular, or some other suitable configuration. Obviously, with whatever selected geometric configuration is chosen as the preferred shape of the prefabricated expandable architecture 170, the structural puzzle segments will likewise require fabrication that when puzzled together, indeed form the desired shape or configuration. Consistent with the objects of the instant invention, the structural puzzle segments are preferably constructed of a substantially resilient and rigid material such as plastic, a type of metal, a ceramic material, wood, or a stress skin panel material such as described in combination with FIG. 8, or other material suitable with use in combination with the instant invention.

It will be appreciated that the plurality of structural puzzle segments as herein described in combination with the prefabricated expandable architecture 170 may be selectively engaged to form the generally pyramidal structure depicted in FIG. 13, or selectively disengaged. As can be seen in FIG. 17, once disengaged, the plurality of structural puzzle segments may be collapsed and nested together to form a first configuration encompassing a first volume. In such a configuration, all of the structural puzzle segments may be transported in a relatively compact configuration from one location to another location as desired, and then reassembled or expanded in a second configuration encompassing a second larger volume, the configuration of which can be seen in FIG. 13. With reference to FIG. 15, as an example of how various structural segments may be nested together, it can be seen that the intermediate structural segments 177 may be selectively separated such that the front structural segment 176 may be slid and retained therebetween. Furthermore with the rear structural segments 178 selectively separated, the intermediate structural segments 177 having the front structural segment nested therewith may be selectively slid and retained therein thus forming a compact orientation.

With reference to FIG. 18, it can be seen that the various plurality of structural puzzle segments may be compactly collapsed and nested together to form the first configuration encompassing the first volume. The first configuration is compact and easily transportable upon a truck or other means for transporting the prefabricated expandable architecture 170 from one location to another. Once transported to a selected site for assembly, the plurality of structural puzzle segments may be selectively disposed or expanded to form the second configuration defining the second larger volume of which can be seen with reference to FIG. 13. This is advantageous because it allows the quick and easy transport of the structure or architecture to a selected site which may then be easily assembled.

Figure 23:
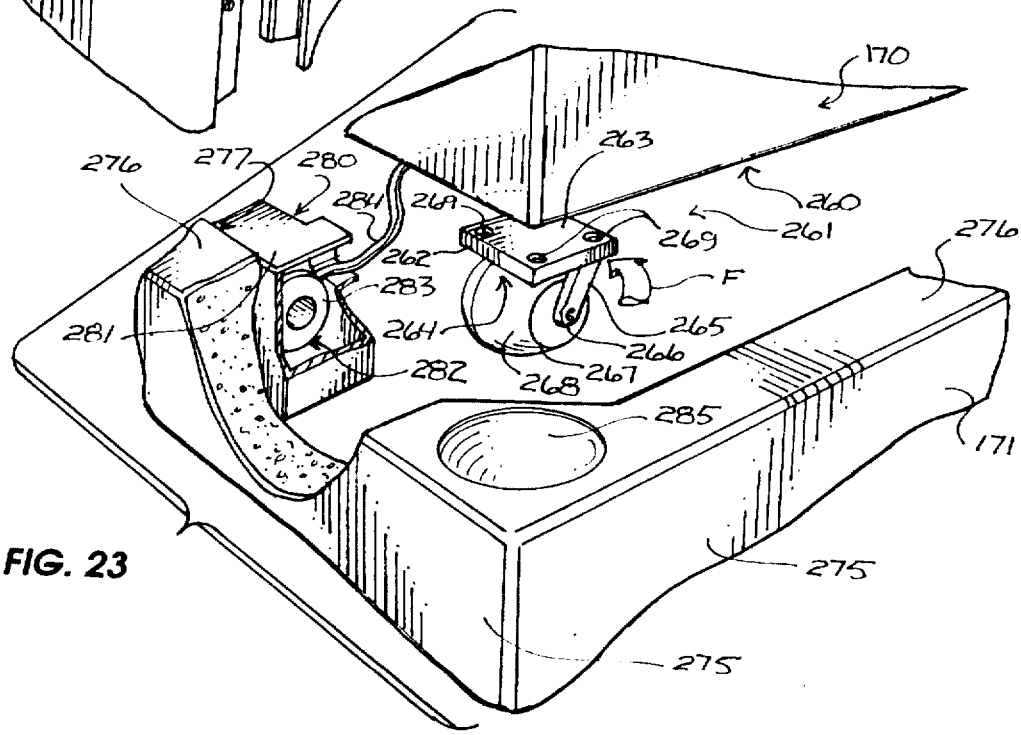
FIG. 23 is an enlarged fragmentary view of portions of the embodiment illustrated in FIG. 13 with portions broken away for the purpose of illustration, and further illustrating a tethering assembly and a wheel assembly.
Figure 38:
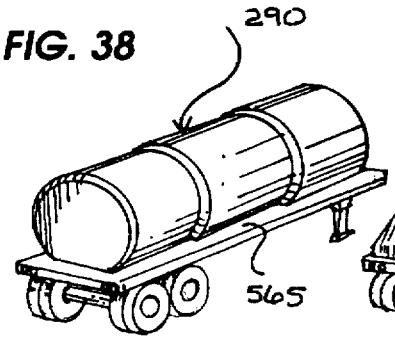
FIG. 38 is a reduced perspective view of the embodiment if the instant invention shown in combination with FIG. 24, and further illustrating the invention as it would appear atop a trailer.
Figure 39:
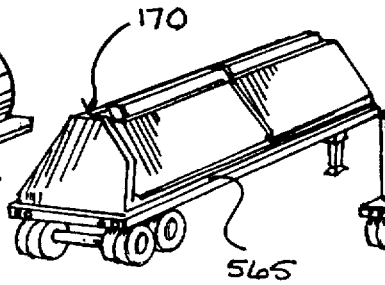
FIG. 39 is a view very similar to the view of FIG. 38.
Figure 40:
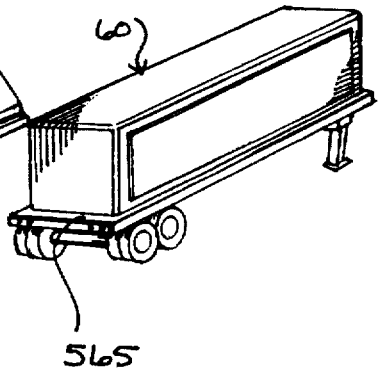
FIG. 40 is a view very similar to the view of FIG. 39.

Reference is now directed to FIG. 23, which illustrates a portion of the foundation 171 upon which the prefabricated expandable architecture 170 may be selectively secured. As can be seen in FIG. 23, extending downwardly from a bottom surface 260 of the prefabricated expandable architecture 170, which is defined by the collective outer surfaces of the array of structural puzzle segments used for constructing the bottom floor portion 172, is seen a wheel assembly 261. The wheel assembly 261 includes a substantially rigid base plate 262 having an upper surface 263 and a lower surface 264. Also included is a bracket member 265 extending downwardly from the lower surface 264 of the base plate 262 and having a free end 266 upon which is rotatably mounted a wheel 267 having a generally rounded outer surface 268. The bracket member 265 is preferably swivelably mounted upon the lower surface 264 of the base plate 262 allowing swivelable motion of the bracket member 265 and the wheel 267 such as in the direction indicated by arrow F. The wheel assembly 261 may be fixedly attached to the bottom surface 260 by means of bolts or screws received through apertures 269 formed through the base plate 262 and then securing the bolts or screws to the bottom surface 260 of the prefabricated expandable architecture 170. Although only one wheel assembly 261 is illustrated, it will be readily appreciated that a plurality of the wheel assembly 261 may be used in combination with the instant invention which allow the prefabricated expandable architecture 170 to be easily moved upon the surface of the ground if desired. Additionally, since the bracket member 265 having the wheel 267 rotatably attached thereto is swivelably mounted upon the base plate 262 which is in turn rigidly and fixedly coupled to the prefabricated expandable architecture 170, the prefabricated expandable architecture 170 is compliantly responsive to external forces such as wind and the like which allows the architecture to swivel and turn selectively and responsively upon an external surface to changing wind conditions or other external or environmental forces when not fixedly mounted upon foundation 171.

The base or foundation 171 is generally a permanent structure formed at a selected site upon which the prefabricated expandable architecture 170 is mounted. The foundation generally includes an outer surface 275, an inner surface 277, and an upper edge 276 upon which portions of the lower surface 260 of the prefabricated expandable architecture 170 may rest upon. Mounted on portions of the inner surface 277 of the foundation 171 is seen a restraint assembly 280. The restraint assembly 280 includes a housing 281 which is rigidly mounted to the inner surface 277 of the foundation 171 by means of bolts or other suitably rigid securing means. The housing 281 is preferably constructed of a substantially rigid resilient material such as a type of metal or other suitably rigid material. Carried within the housing 281 is seen a self winding tether assembly 282 consisting of a spool member 283 upon which is secured and wound a tether 284 which is resiliently extensible and may suitably be a rope or a chain or another suitably resilient and windable member. The tether 284 further includes an end (not herein specifically shown) which is fixedly coupled to portions of the bottom surface 260 of the prefabricated expandable architecture 170.

The restraint assembly 280 serves as a means for selectively and detachably restraining the prefabricated expandable architecture 170 against the upper edge 276 of the foundation 171. The restraint assembly allows the prefabricated expandable architecture 170 to become displaced apart from the foundation 171 without actually becoming totally detached from the foundation 171. For example, in the event the prefabricated expandable architecture becomes exposed to flood waters which overtake the structure, it would be exposed to the flooding and damage if the architecture was fixedly attached to the foundation 171. However, the restraint assembly allows the prefabricated expandable architecture 170 to selectively disengage from the foundation upon actuation of the restraint assembly when the architecture is exposed to flood waters. Specifically, the prefabricated expandable architecture 170 is able to float upon water. Therefore, when exposed to flood waters, the spool member 283 of the tether assembly selectively actuates and unwinds allowing the prefabricated expandable architecture to detach selectively from the foundation and float, as the tether acts a restraint for preventing the architecture from floating away. Once flood water recede, the spool assembly 283 selectively actuates and winds up the tether 284 thereby bringing the prefabricated expandable architecture 170 to rest upon the upper edge 276 of the foundation 171. Additionally, the wheel assembly 261 is received within recessed portion 285 formed in portions of the foundation 171 proximate upper edge 276.

Attention is now directed to FIG. 24 and FIG. 25 which illustrate yet another alternate embodiment of the instant invention comprising a prefabricated expandable architecture generally designated by the reference character 290. The prefabricated expandable architecture 290 includes a plurality of generally frustoconical structural segments 291 having an outer end 292 and an inner end 293. Each segment 291 includes a generally flat lower panel 296 having an inner surface 297 and an outer surface 298 having a plurality of protruding contact members 298A engagable with an external surface, and a semiannular generally cone shaped structural member 300 having an outer surface 301, an inner surface 302, and lower ends 305 and 306 rigidly coupled to portions of the inner surface 297 of panel 296. The inner surface 297 of each lower panel 296 and the inner surface 302 of each structural member 300 define a volume 303 which each structural segment 291 encompasses. It will be noted that coupled to portions of inner surface 297 and inner surface 302 are present fixtures or storage units consisting of cabinets 308 and cupboards 309 into which may be stored selected items.

The structural segments 291 are telescopingly movable relative each other much in the same way the front structural segment 61, the intermediate structural segment 62, and the rear structural segment 63 are telescopingly disposed which has been herein described in combination with FIG. 1, FIG. 2, and FIG. 5. As can be seen in FIG. 24, the structural segments 291 may be telescopingly extended in the direction indicated by arrow G such that the structural segments 291 making up the prefabricated expandable architecture 290 encompass a second larger volume in a second configuration, the second larger volume being defined as all of the individual volumes 303 of each respective structural segment 291. Additionally, the structural segments 291 may also be telescopingly collapsed in the opposite direction of arrow G thereby forming a relatively compact configuration or a first configuration in which the structural segments 291 encompass a first volume. Much like the prefabricated expandable architecture 60 discussed previously, prefabricated expandable architecture 290 is movable between a first configuration in which the structural segments 291 are telescopingly collapsed together in the first configuration having the first volume, and a second configuration in which the structural segments 291 are telescopingly extending in the second configuration having the second larger volume.

It will be appreciated that when the structural segments 291 are telescopingly expanded or extended in the second configuration, it is desirable to engage the inner ends 293 with the outer ends 292 for securing the prefabricated expandable architecture 290 in the second configuration. Consistent with the embodiment illustrated in combination with FIG. 1, an element of an engagement pair may be selectively provided proximate the outer end 292 of each structural segment 291, and a complemental element of the engagement pair may be selectively provided proximate the inner end 293 of each structural segment 291. The element and the complemental element of the engagement pair may then be selectively engaged when the structural segments 291 are telescopingly moved or disposed in the second configuration. Although any preferred and suitable engagement pair may be used in combination with the prefabricated expandable architecture illustrated in FIG. 24, it is preferable to use the engagement pair 124 illustrated in combination with FIG. 9 which would facilitate the rigid coupling of the structural segments 291. Additionally, sealing elements such as the sealing elements 138 and 139 described in combination with FIG. 9 may also be incorporated with the engagement pair for hermetically sealing the structural segments 291 together.

Each structural member 300 includes two inwardly biased diverging elements, 310 and 311. Each element 310 and 311 include mating edges, 312 and 313 respectively. The diverging elements spread apart when the structural segments 291 are telescoped in the first configuration, and bias together such that the mating edges 312 and 313 mate in the second configuration, of which can be seen in FIG. 24. Therefore, in the second configuration, the mating edges 312 and 313 may be selectively coupled together with the use of the same tongue and groove engagement pair discussed in combination with FIG. 21 and FIG. 22, or any other preferred and suitable engagement means. Additionally, the mating edges 312 and 313 may be hermetically sealed together with the use of sealing elements such as sealing elements 138 and 139, for hermetically sealing the mating edges 312 and 313 together.

The prefabricated expandable architecture 290 described in combination with FIG. 24 and FIG. 25, may be suitably fitted with piping and utility connections for supplying the architecture with necessary amenities such as water, electricity, gas, sewer, and phone service. For instance, extending from the outer end 292 of one of the frustoconical shaped segments 291 are seen a plurality of pipe members 318 which may be used for carrying, supplying, and transporting substances such as water, gas, and sewer throughout the prefabricated expandable architecture 290. The pipe members may be constructed of any suitable and preferred material such as copper, plastic, or other suitable material suitable for carrying and transporting such substances.

With reference directed to FIG. 28, illustrated is one such pipe member 318. Each pipe member 318 includes a generally cylindrical outer surface 319 and a free end 320. The pipe member 318 also includes a sealing member 321 comprising a generally cylindrical member 322 having a generally cylindrical outer surface 323 and a bore 324 through which is closely received the pipe member 318. Although not herein specifically shown, the sealing member 321 serves a coupling means for coupling the pipe member 318 to portions of the structural segment 291. Additionally, it is preferable for the sealing member 321 to be constructed of a flexibly resilient material such as silicone rubber for supplying compliance between the structural segment 291 and the pipe member 318, which is necessary as the prefabricated expandable architecture 290 is telescopingly moved between the first configuration and the second configuration.

Also shown in FIG. 28 is a fitting element 330. The fitting element 330 shown includes a generally tubular member 331 having a generally cylindrical outer surface 332, a free end 333, a generally cylindrical inner surface 334 defining an internal passage 335. The fitting element also includes a plurality of flexibly resilient annular ribs 336 disposed on inner surface 334. The annular ribs 336 are preferably constructed of silicone rubber or some other suitable flexibly resilient material. Each pipe members 318 may be selectively received within the internal passage 335 of the fitting element 330 as the prefabricated expandable architecture 290 is selectively telescoped. As the pipe member 318 enters the internal passage 335 of the fitting element 336, the annular ribs 336 function as a sealing means for closely sealing the fitting element to the outer surface 319 of the pipe member 318 such that when substances such as water, gas, and sewer are selectively passed through the pipe members 318, leaking is prevented at the site where the pipe members 318 are connected together by the fitting element 330. Therefore, the fitting element 330 functions to selectively and sealing connect and selectively disconnect opposing pipe members 318 as the prefabricated expandable architecture 290 is selectively telescoped.

With reference directed to FIG. 27, illustrated is a segment of a piping matrix 340 that may be used in combination with the instant invention for carrying selected substances such as water, gas, sewer, or electrical wiring. The piping matrix 340 includes flexibly piping members 341 interconnected by an array of flexible joint members 342 for creating a selected matrix of flexible piping. The flexible or compliant nature of the piping matrix 340 is desirable for providing a compliant piping system throughout the prefabricated expandable architecture 290 so that when the prefabricated expandable architecture 290 is telescoping disposed between the first configuration and the second configuration, the piping matrix 340 will flex and give in response to movement so that it will not break or become compromised. The piping members 341 and the joint members 342 may be constructed of any suitable flexibly resilient material such as flexible rubber, silicone rubber, flexible plastic, or other suitable flexibly resilient material.

With reference to the subject matter disclosed in combination with FIG. 25 and FIG. 26, the prefabricated expandable architecture 290 may be fitted with cooperable plug members that may be selectively connected and disconnected when the prefabricated expandable architecture 290 is telescopingly disposed between the first configuration and the second configuration. The cooperable plug members include a first plugging member 345 and a second plugging member 346. The first plug member 345 includes a housing 347 having an upper surface 348, a lower surface 349, side surfaces 350, a rear surface 351, and a front face surface 352. Disposed proximate the front face surface 352 exist a plurality of mating plug receptors 356 and vertically disposed elongate protruding alignment member 357. The second plugging member 346 includes a housing 360 having an upper surface 361, a lower surface 362, side surfaces 363, a rear surface 364, and a front face surface 365. Disposed proximate the front face surface 365 of the second plug member 346 exist a plurality of outwardly extending plug elements 368 and a vertically disposed elongate recess 369. When the prefabricated expandable architecture 290 is selectively telescoped into the second configuration, the cooperable plug members move together in the direction indicated by the arrowed line H such that the plug elements 38 become received and disposed into the mating plug receptors 356, and the alignment member 357 becomes selectively disposed into the elongate recess 369 for aligning the cooperable plug members in proper mating alignment. Once the cooperable plug members are mated together, electrical power, phone service, and other electrically oriented utilities become operable and thereby supplied to the prefabricated expandable architecture 290. It will be readily understood that the cooperable plug members may be selectively connected and disconnected being responsive to the telescoping action of the prefabricated expandable architecture 290, and may reside in any preferred location such as proximate the outer end 292 of each frustoconically shaped section 291.

Reference is now directed to FIG. 29 and FIG. 30 which illustrate yet still another alternate embodiment of a prefabricated expandable architecture being generally designated by the reference character 375. The prefabricated expandable architecture 375 includes a front section 376, an intermediate section 377, and a rear section 378, all generally formed in the shape of a rectangle. The front section 376 is comprised of single rectangular member 379 having an upper surface 380, side surfaces 381, a front surface 382, a rear end 383 that may be either an open end or a closed and as desired, and a lower surface 384. The intermediate section 377 and the rear section 378 are each comprised of a plurality, specifically four, structural segments 388 that when selectively disposed together, generally form the shape of a rectangle. Each structural segment includes a panel 389 having an laterally extending sidewall 390. Each panel 389 includes an outer surface 391, an inner surface 392, and each sidewall 390 includes an outer surface 393 and an inner surface 394. Furthermore, each structural segment 388 includes side edges, 398 and 399, inner edge 400, and upper edge 401.

As can be seen from FIGS. 29 and 31, the structural segments 388 may be selectively stacked on top of each other around the outer surfaces of rectangular member 379 in a first configuration which is relatively compact in which the structural segments 388 and the rectangular member 379 encompass a first volume. Although eight structural segments 388 have been depicted in FIG. 28 and FIG. 29, FIG. 30 illustrates twelve structural segments 388 nested around the rectangular member 379, all of which when combined together would form an additional section beyond the front, intermediate, and rear sections. Additionally, the structural segments 388 making up the intermediate section 377 and the rear section 378 may be selectively moved or disposed respectively in juxtaposition in the direction indicated by arrow I and then fitted and coupled together in mating relationship to form a floor structure depicted in FIG. 29 which is a second configuration in which the structural segments 388 and the rectangular member 379 encompass a second larger volume. Once disposed in the second configuration depicted in FIG. 29, the side edges 388 and 389 of the structural segments, which comprise mating edges, may be coupled together by means a suitable engagement means such as the engagement means illustrated in combination with FIG. 9 or FIG. 16, details of which have been herein specifically described. The structural segments 388 and the rectangular member 379 are preferably substantially rigid in configuration and may be suitably constructed of any desired material such as wood, a type of metal, or a skin stressed panel material such as herein discussed in combination with FIG. 8. Additionally, the structural segments 388 and the rectangular member 379 may be rigidly coupled by means of the above mentioned engagement means, and may also be hermetically sealed if desirable.

It will be appreciated that the structural segments 388 may be selectively nested about the rectangular member 379 in any desired and suitable configuration. For instance, FIG. 33 illustrates how a plurality of structural segments 388 may be nested together upon portions of the upper surface 380 of the rectangular member 379. Additionally, FIG. 34 illustrates two structural segments 388 nested upon one another proximate the lower surface 384 of the rectangular member 379, and four structural segments 388 nested together proximate the upper surface 380 of the rectangular member 379. Also shown in combination with FIG. 34 is a substantially flat floor panel 402 that may be used to create a rigid floor portion within the prefabricated expandable architecture 375 when disposed in the second configuration. It will be readily appreciated that the structural segments 388 and the rectangular member 379 defining the prefabricated expandable architecture 375 may be of any preferred sized and dimension as suitably desired. Additionally, although only one floor panel 402 has been illustrated in combination with the above referenced drawings, an array of floor panels 402 may be used in combination therewith for creating selected floor portions within the prefabricated expandable architecture 375 when disposed in the second configuration.

Reference is now directed to FIG. 32, which illustrates the prefabricated expandable architecture 375 depicted in FIG. 29 that is surrounded by a plurality of structural members. The structural members illustrated are comprised of eight corner segments 500, and four intermediate segments 501. Each corner segment 500 includes a substantially flat panel 502 having two downwardly extending sidewalls 503 and 504. Each panel 502 includes an outer surface 505 and an inner surface 506. Each sidewall 503 includes an outer surface 510 and an inner surface 511, and each sidewall 504 includes an outer surface 512 and an inner surface 513. Furthermore, each corner segment 500 includes a side mating edge 516, an inner mating edge 517, and a lower mating edge 518. Each intermediate segment 501 includes a substantially flat panel 520 having a downwardly extending sidewall 521. Each flat panel 520 includes an outer surface 522 and an inner surface 523, and each sidewall 521 includes an outer surface 524 and an inner surface 525. Additionally, each intermediate segment 501 further includes side edges 526 and 527, an inner edge 528, and a lower edge 529.

As can be seen in FIG. 32, the corner segments 500 and the intermediate segments 501 may be either compactly nested on top of one another about the prefabricated expandable architecture 375 in a first configuration, or displaced or expanded respectively along the axis represented by the arrow J and arrow K in a second configuration in which they may be rigidly coupled together in the same manner described in combination with FIG. 29 to create a further expanded floor structure encompassing a greater volume that the second larger volume encompassed by the prefabricated expandable architecture 375. Alternatively, the corner segments 500 and the intermediate segments 501 may be selectively and respectively displaced or expanded in the direction indicated by arrow L and then rigidly coupled together upon the prefabricated expandable architecture 375 to create a second floor structure.

As can be seen with reference to FIGS. 35 and 37, and in light of the prefabricated expandable architecture illustrated in FIG. 29, any suitable number and size of structural segments may be used in combination with the instant invention to create a structure or architecture encompassing a selected and desired volume. For instance, the FIG. 35 illustrates a further embodiment of a prefabricated expandable architecture being generally designated by the reference character 535. Prefabricated expandable architecture 535 illustrates a plurality of structural segments selectively disposed and coupled together to form a structure or architecture having three floor levels comprised of a bottom floor level 536, an intermediate floor level 537, and an upper floor level 537. With reference to FIG. 37, shown are a plurality of structural segments surrounding a floor structure comprised of a prefabricated expandable architecture 540 which has been constructed in much the same way as the prefabricated expandable architecture of FIG. 29. The plurality of structural segments surrounding the prefabricated expandable architecture 540 include a plurality of corner segments 541, a plurality of end intermediate segments 542, a plurality of side intermediate segments 543, and a substantially flat central panel 544. All of these structural segments have similar structural characteristics and surfaces as the structural segments herein described in combination with FIG. 29, FIG. 30, and FIG. 32, details of which will not be herein again specifically described. Yet, all of the structural segments noted in combination with FIG. 37 may be S selectively and respectively disposed or displaced in the direction indicated by arrow M and then rigidly coupled together similar to the rigid coupling means described in combination with the embodiment disclosed in FIG. 29, to form the embodiment depicted in FIG. 35.

With reference directed to FIG. 36, illustrated is a support member 548 having a plurality of support columns 549 each having a generally cylindrical outer surface 550. Each support column 549 has opposing ends (not herein specifically shown) each coupled to a bracket member 551 which is fixedly coupled to an annular support flange 552. Each bracket member 551 includes a generally cylindrical member 553 having a generally cylindrical outer surface 554 and a generally cylindrical bore 555 through which is disposed and fixedly retained one of the ends of one of the support columns 549. Each end of each of the support column 549 may be fixedly retained within the bore 555 of each bracket member by means of a bolt 556 extending through a threaded aperture formed through the bracket member which may be selectively rotated and tightened for bearing against the outer surface 550 of the support column 549 thereby frictionally and fixedly retaining the support column 549 therein. The bolt 556 shown includes a recess 557 specifically sized for receiving the end of an Allen head wrench. Each annular support flange 552 includes a disk shaped member 560 having an upper surface 561, a lower surface 562, an annular outer edge 563, and a bore 564 through which is received an end of a respective support column 549.

As can be seen in FIG. 37, the support member 548 may be selectively disposed within the prefabricated expandable architecture 535 for selectively supporting the intermediate floor level 537 above the bottom floor level 536, and for selectively supporting the upper floor level 538 above the intermediate floor level 537. When disposed in combination with prefabricated expandable architecture 535, the annular support flanges 552, which may be constructed of any suitably resilient material such as resilient plastic or a type of metal, bear against portions of the bottom floor level 536, the intermediate floor level 537, and the upper floor level 538 for support. Additionally, the support columns may be suitably constructed of a strong resilient material such as a type of metal or other suitable material, and may by possess extended height characteristics such as that of a conventional jack used in jacking up vehicles, for lifting the structural segments to a selected height for aiding in disposing the array of structural segments from the first configuration in FIG. 37, to the second configuration in FIG. 35.

Reference is finally directed to FIG. 38, FIG. 39, FIG. 40, and FIG. 41, all of which illustrate how prefabricated expandable architectures 290, 170, and 60, seen in the first configuration or otherwise collapsed, may be suitably disposed for transport atop the upper surface 565 of a flatbed trailer 566. Although the above referenced figures illustrate how a selected prefabricated expandable architecture may be suitable disposed for easy transport atop a flatbed trailer, it will be readily appreciated by those having ordinary skill that a selected prefabricated expandable architecture may be transported by any selected and suitable transporting means such as, but not limited to, an airplane, a boat, or perhaps a vehicle specifically designed for extraterrestrial travel.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A prefabricated expandable architecture comprising:

a plurality of structural segments defining a first volume in a first configuration and a second larger volume in a second configuration, wherein said structural segments include a plurality puzzle segments movable from a nested orientation defining the first configuration and an expanded interconnected orientation having a predetermined shape de4fining the second configuration; and rigid coupling means for rigidly coupling said structural segments together in said second configuration.

2. The prefabricated expandable architecture of claim 1, wherein said plurality of structural segments are disposed in telescoping relation.

3. The prefabricated expandable architecture of claim 2, wherein said structural segments include a front structural segment, an intermediate structural segment, and a rear structural segment, disposed in telescoping relation respectively, and telescopingly movable between said first configuration and said second configuration.

4. The prefabricated expandable architecture of claim 3, wherein:

said front structural segment includes a continuous sidewall encompassing a front volume and having a first peripheral rim;

said intermediate structural segment includes a continuous sidewall encompassing an intermediate volume and disposed in telescoping relation relative said first peripheral rim of said front structural segment; and said rear structural segment includes a continuous sidewall encompassing a rear volume and disposed in telescoping relation to a second peripheral rim of said intermediate structural segment.

5. The prefabricated expandable architecture of claim 4, wherein:

said front structural segment includes a second closed end; and said rear structural segment includes a second closed end.

6. The prefabricated expandable architecture of claim 4, wherein said rigid coupling means includes a plurality of engagement pairs, each of said engagement pairs including:

an element proximate said first peripheral rim of said front structural segment, and a complemental element proximate portions of said intermediate structural segment, said element selectively engagable with said complemental element when said front structural segment and said intermediate structural segment are telescopingly disposed in said second configuration; and said element proximate said second peripheral rim of said intermediate structural segment, and a said complemental element proximate portions of said rear structural segment, said element selectively engagable with said complemental element when said intermediate structural segment and said rear structural segment are telescopingly disposed in said second configuration.

7. The prefabricated expandable architecture of claim 6, wherein said element and said complemental element of said engagement pairs include opposing generally L-shaped retaining flanges.

8. The prefabricated expandable architecture of claim 6, wherein said rigid coupling means further includes sealing means proximate each of said engagement pairs for sealingly and lockingly engaging said engagement pairs together when engaged.

9. The prefabricated expandable architecture of claim 8, wherein said sealing means includes a hermetic seal system for selectively creating a hermetically sealed expandable architecture when said prefabricated expandable architecture is disposed in said second configuration.

10. The prefabricated expandable architecture of claim 9, wherein said hermetic seal system includes a sealing element disposed proximate said element of said engagement pair, and another of said sealing elements disposed proximate said complemental element of said engagement pair, whereupon the heating of said sealing elements facilitates the hermetic sealing of said engagement pair.

11. The prefabricated expandable architecture of claim 1, wherein each of said puzzle segments include mating edges selectively engagable in mating relationship in said second configuration to form said predetermined shape.

12. The prefabricated expandable architecture of claim 11, wherein said rigid coupling means is suitably located proximate said mating edges.

13. The prefabricated expandable architecture of claim 12, wherein said rigid coupling means includes a plurality of engagement pairs, each of said engagement pairs including an element proximate one of a selected of said mating edges, and an opposing complemental element proximate one of another of a selected of said mating edges, said element and said complemental element being selectively and lockingly engagable when said puzzle segments are disposed in said second configuration.

14. The prefabricated expandable architecture of claim 13, wherein:

each of said elements of each of said engagement pairs includes a latch member having an end hingedly mounted proximate one of a selected of said mating edges, and a free end having a hook member integral therewith; and each of said opposing complemental elements of each of said engagement pairs includes a recessed portion proximate one of another of a selected of said mating edges, said hook member being selectively and lockingly engagable therein said recessed portion.

15. The prefabricated expandable architecture of claim 13, wherein:

each of said elements of each of said engagement pairs includes an elongate tongue member having an end fixedly mounted proximate one of a selected of said mating edges, and terminating with a free end; and each of said opposing complemental elements of each of said engagement pairs includes a groove formed proximate one of another of a selected of said mating edges, said free end of said elongate tongue member being selectively engagable therein said groove.

16. The prefabricated expandable architecture of claim 15, wherein said free end of said elongate tongue member includes a plurality of equally spaced apart apertures such that when said free end is engaged within said groove, said apertures become aligned with complemental apertures formed proximate said groove, said apertures and said complemental apertures selectively sized for receiving a camming element such that when actuated in a certain direction, bears and lockingly engages said elongate tongue member against said groove.

17. The prefabricated expandable architecture of claim 1, wherein said predetermined shape is substantially pyramidal.

18. A method of making a prefabricated expandable architecture, said method comprising the steps of:

providing a plurality of structural segments defining a first volume in a first configuration and a second larger volume in a second configuration, wherein said structural segments include a plurality puzzle segments movable from a nested orientation defining the first configuration and an expanded interconnected orientation having a predetermined shape defining the second configuration; and rigidly coupling said structural segments together in said second configuration.

19. The method of making said prefabricated expandable architecture of claim 18, wherein said step of providing said plurality of structural segments includes the step of disposing said plurality of structural segments in telescoping relation.

20. The method of making said prefabricated expandable architecture of claim 19, wherein said step of providing said plurality of structural segments includes the steps of:

providing a front structural segment having a continuous sidewall encompassing a front volume;

providing an intermediate structural segment having a continuous sidewall encompassing an intermediate volume;

providing a rear structural segment having a continuous sidewall encompassing a rear volume.

21. The method of making said prefabricated expandable architecture of claim 20, further including the step of disposing said front structural segment, said intermediate structural segment, and said rear structural segment in telescoping relation respectively, such that said front, intermediate, and rear structural segments may be selectively and telescopingly movable between said first configuration and said second configuration.

22. The method of making said prefabricated expandable architecture of claim 21, wherein said step of rigidly coupling said structural segments together includes the step of providing a plurality of engagement pairs, wherein said step of providing said plurality of engagement pairs includes the steps of:

providing an element of one of said engagement pairs proximate portions of said front structural segment;

providing a complemental element of one of said engagement pairs proximate portions of said intermediate structural segment; and selectively engaging said element to said complemental element when said front structural segment and said intermediate structural segment are telescopingly disposed in said second configuration.

23. The method of making said prefabricated expandable architecture according to claim 22, wherein said step of providing said plurality of engagement pairs further includes the steps of:

providing said element of one of said engagement pairs proximate portions of said intermediate structural segment;

providing said complemental element of one of said engagement pairs proximate portions of said rear structural segment; and selectively engaging said element to said complemental element when said intermediate structural segment and said rear structural segment are telescopingly disposed in said second configuration.

24. The method of making said prefabricated expandable architecture of claim 23, wherein:

said step of providing said element of one of said engagement pairs further includes the step of providing said element as a generally L-shaped retaining flange; and said step of providing said complemental element of one of said engagement pairs further includes the step of providing said complemental element as a generally L-shaped retaining flange.

25. The method of making said prefabricated expandable architecture of claim 23, wherein said step of rigidly coupling said structural segments together still further includes the step of hermetically sealing said element and said complemental element of said engagement pairs together for hermetically and lockingly sealing said structural segments together when disposed in said second configuration.

26. The method of making said prefabricated expandable architecture of claim 25, wherein said step of hermetically sealing further includes the step of providing sealing elements, said step of providing sealing elements including the steps of:

providing one of said sealing elements proximate said element of said engagement pair; and providing another of said sealing elements proximate said complemental element of said engagement pair; and selectively heating said sealing elements for hermetically sealing said element and said complemental element of one of a selected of said engagement pairs together.

27. The method of making said prefabricated expandable architecture of claim 18, wherein said step of rigidly coupling said structural segments together includes the steps of:

providing said plurality of structural puzzle segments with mating edges;

selectively and rigidly engaging said mating edges in mating relationship to form said second configuration.

28. The method of making said prefabricated expandable architecture of claim 27, wherein said step of selectively and rigidly engaging said mating edges in mating relationship to form said second configuration, further includes the steps of providing a plurality of engagement pairs proximate said mating edges.

29. The method of making said prefabricated expandable architecture of claim 28, wherein said step of providing said plurality of engagement pairs further includes the steps of:

providing an element of each of said engagement pairs proximate one of a selected of said mating edges;

providing an opposing complemental element of each of said engagement pairs proximate one of another of a selected of said mating edges; and selectively and lockingly engaging said element to said complemental element when said structural puzzle segments are disposed in said second configuration.

30. The method of making said prefabricated expandable architecture of claim 29, wherein said step of providing said element includes the steps of:

providing a latch member having an end and a free end having a hook member integral therewith; and hingedly coupling the end of the latch member proximate one of a selected of said mating edges.

31. The method of making said prefabricated expandable architecture of claim 30, wherein said step of providing said opposing complemental element includes the step of providing a recessed portion proximate one of another of a selected of said mating edges.

32. The method of making said prefabricated expandable architecture of claim 31, wherein said step of rigidly coupling said structural segments together further includes the step of selectively and lockingly engaging said hook member in said recessed portion.

33. The method of making said prefabricated expandable architecture of claim 29, wherein said step or providing said element includes the steps of:

providing an elongate tongue member having an end and a free end;

fixedly mounting the end of said elongate tongue member proximate one of a selected of said mating edges.

34. The method of making said prefabricated expandable architecture of claim 33, wherein said step of providing said opposing complemental element includes the step of forming a groove proximate one of another of a selected of said mating edges.

35. The method of making said prefabricated expandable architecture of claim 34, further including the step of selectively engaging said free end of said elongate tongue member in said groove when said prefabricated expandable architecture is disposed in said second configuration.

36. The method of making said prefabricated expandable architecture of claim 35, further including the steps of:

providing a plurality of equally spaced apart aperture proximate the free end of said elongate tongue member;

providing a plurality of equally spaced apart opposing apertures proximate said groove;

aligning said apertures and said opposing apertures together when said elongate tongue is disposed in said groove;

inserting a camming element in each of said apertures and said opposing apertures; and actuating said camming element in a certain direction for bearing and lockingly engaging the elongate tongue member against said groove.

37. The method of making said prefabricated expandable architecture of claim 18 further including the step of providing said prefabricated expandable architecture as a generally pyramid shaped architecture when disposed in said second configuration.

38. The method of making said prefabricated expandable architecture of claim 18 further including the step of providing said prefabricated expandable architecture as a generally rectangular shaped architecture when disposed in said second configuration.

* * * * *